US006249655B1

(12) United States Patent
Baek et al.

(10) Patent No.: US 6,249,655 B1
(45) Date of Patent: Jun. 19, 2001

(54) INK DELIVERY SYSTEM OF LIQUID ELECTROPHOTOGRAPHIC COLOR PRINTER AND INK REFILLING METHOD THEREOF

(75) Inventors: Chung-guk Baek, Suwon; Jong-woo Kim, Yongin; Seung-ho Hong, Suwon, all of (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/525,168

(22) Filed: Mar. 14, 2000

(30) Foreign Application Priority Data

Mar. 15, 1999 (KR) ..... 99-8585

(51) Int. Cl.[7] ..... G03G 15/01; G03G 15/10

(52) U.S. Cl. ..... 399/12; 222/DIG. 1; 399/237; 399/250

(58) Field of Search ..... 399/237, 238, 399/119, 120, 12, 250, 224, 233; 222/DIG. 1; 347/85, 86, 214

(56) References Cited

U.S. PATENT DOCUMENTS 5,950,054 * 9/1999 Kim ..... 399/237
6,032,010 * 2/2000 Kim et al. ..... 399/238
6,101,356 * 8/2000 Kim et al. ..... 399/250

FOREIGN PATENT DOCUMENTS 5-165299 * 7/1993 (JP) .

* cited by examiner

*Primary Examiner*—Sophia S. Chen
(74) *Attorney, Agent, or Firm*—Sughrue, Mion, Zinn, Macpeak & Seas, PLLC

(57) ABSTRACT

An ink delivery system of a liquid electrophotographic color printer which supplies liquid developers of predetermined concentration, each of which is a mixture of a toner and a liquid carrier, to a plurality of respective developing units, and which recovers the carrier using a drying/condensing unit which absorbs and evaporates the carrier remaining on the photosensitive medium after development. A plurality of circulation tanks store respective developers to be supplied to a corresponding developing unit. Respective concentration measuring devices measure the concentration of the developers. A waste tank receives waste developer produced in the plurality of circulation tanks, and includes a waste developer agitating device for agitating the waste developer. A plurality of ink storage tanks store concentrated inks of predetermined colors to be supplied to the respective circulation tanks, and include respective ink agitators driven by a single driving source. A carrier storage tank stores a carrier to be supplied to the circulation tanks, and having an inclined surface at the bottom so that water and a liquid carrier condensed by the drying/condensing unit can be stored in a stratified state. A refill cartridge stores a concentrated ink or carrier with compressed air and is removably installed at a common installation portion provided at the main body of the printer. A developer refilling/waste recovering mechanism refills a concentrated ink or carrier of the refill cartridge into a corresponding ink storage tank or carrier storage tank and recovers the waste developer stored in the waste tank to an empty refill cartridge.

28 Claims, 22 Drawing Sheets

INK DELIVERY SYSTEM OF LIQUID ELECTROPHOTOGRAPHIC COLOR PRINTER AND INK REFILLING METHOD THEREOF

BACKGROUND OF THE INVENTION

1. Field of the Invention

The present invention relates to an ink delivery system of a liquid electrophotographic color printer and an ink refilling method thereof, and more particularly, to an ink delivery system of a liquid electrophotographic color printer, which has a structure capable of refilling a plurality of ink storage tanks and a carrier storage tank which are installed in a main body of the printer with corresponding one of concentrated inks or a carrier by using a refill cartridge so as to supply liquid developers to developing units, and capable of recovering waste developer within a waste tank into an empty cartridge, and an ink refilling method thereof.

2. Description of the Related Art

In general, in a color printing device such as a color laser printer or a color copier, a latent electrostatic image formed on the surface of a photosensitive medium such as a photosensitive belt is developed with a liquid developer composed of a solid toner having a predetermined color and a liquid carrier functioning as a solvent, and the developed image is transferred to a paper.

A conventional liquid electrophotographic color printing device is provided with ink cartridges and a carrier cartridge which are installed to be replaceable at a main body of the printing device. The color printing device has an ink supplying structure in which concentrated inks and a carrier within the cartridges are supplied to respective developing units, and liquid developers required for the printing device are made by mixing the concentrated inks and the carrier. Here, the liquid developers are solutions made by mixing, in predetermined proportions, the concentrated inks composed of powder toners and are supplied from the ink cartridges and liquid carrier supplied from the carrier cartridge. The toners include pigments exhibiting colors of yellow, magenta, cyan, and black, respectively.

However, since the above cartridges supply the concentrated inks or the carrier contained therein to the developing unit via a predetermined passage and a pump, there is a disadvantage in that the passage between the cartridge and the developing unit is long. Also, although the cartridge has a characteristic of a consumable part, a functional part such as an agitator must be installed so that contents stored in the cartridge do not precipitate. Therefore, the conventional ink delivery system has a disadvantage in which the system is expensive.

Recently, in order to reduce the cost thereof, a printing device employs an ink delivery system in which tanks are provided in the vicinity of developing units. The functional parts such as an agitator can be omitted, and a refill cartridge is installed at the outside of a main body of a printer for supplying a carrier or inks to the respective tanks.

In a liquid developer circulation process of an ink delivery system, liquid developer which has been recovered at a corresponding circulation tank via a development gap of a developing unit and a drying/condensing unit is transferred from one developing unit to another, neighboring, developing unit by a circulating photosensitive medium. Such a developer mixing event in which the transferred developer is mixed with a peculiar developer in a circulation tank, i.e., cross contamination occurs. Therefore, when printing jobs are repeatedly performed, the purity of the liquid developers of the circulation tanks is not maintained within an allowable range due to the cross contamination, and the liquid developers stored in the circulation tanks become unusable waste developer. Under this situation, the waste developer must be discharged out of the circulation tank, and new inks and new carrier are refilled to the circulation tanks. Thus, a waste tank is installed at a printing device for recovering waste developer within the circulation tank.

In addition, although the waste developer in the waste tank can be recovered to a separate waste bottle installed at the printing device, a method of recovering waste developer by using an empty refill cartridge, corresponding to a tendency in which an ink delivery system employs a refill cartridge, is under consideration.

SUMMARY OF THE INVENTION

To solve the above problems, it is an objective of the present invention to provide an ink delivery system of a liquid electrophotographic color printer, in which the structure thereof is improved so that any one of the concentrated inks and a liquid carrier, stored in a cartridge together with compressed air, is refilled to a corresponding ink tank and a carrier tank equipped within the main body of the printer. Waste developer stored in a waste tank is recovered. When any one of the ink refill cartridges storing yellow, magenta, cyan, and black inks, respectively, a carrier refill cartridge, and an empty cartridge are installed at a common installation portion, a corresponding valve of a plurality of valves installed at a valve block can be automatically connected to the cartridge.

It is another objective of the present invention to provide an ink delivery system of a liquid electrophotographic color printer, in which, in a printer employing a refill cartridge, the structure of securing the refill cartridge after the refill cartridge is installed at a common installation portion is improved, and the recognition of the identity of the contents of the cartridge is also improved.

It is still another objective of the present invention to provide an ink delivery system of a liquid electrophotographic color printer, in which the structure of a waste tank is improved to prevent waste developer from adhering to a bottom surface or a discharge port of a waste tank by installing a cylindrical agitator of a predetermined shape at the bottom surface of the waste tank and circulating the waste developer through the cylindrical agitator with a pump.

It is still another objective of the present invention to provide an ink delivery system of a liquid electrophotographic color printer, in which the structure thereof is improved so that agitating devices installed in a plurality of ink storage tanks can be driven by one driving source by using a belt-pulley and a clutch.

It is still another objective of the present invention to provide an ink delivery system of a liquid electrophotographic color printer having a developer concentration measuring device which is configured to form a developer film of a predetermined thickness on the surface of a rotating roller, and to measure the transmittance of light of the developer so as to measure the concentration of the developer within a circulation tank to be supplied to a developing unit.

It is still another objective of the present invention to provide an ink delivery system of a liquid electrophotographic color printer having a carrier tank which is configured to separate a carrier and water, which are condensed in a drying/condensing unit and are recovered to the carrier tank separate from each other.

It is still another objective of the present invention to provide an ink refilling method of a liquid electrophotographic color printer, in which an ink or carrier within a refill cartridge can be automatically supplied to an ink tank or carrier tank, and waste developer within a waste tank can, if necessary, be recovered to an empty cartridge.

Accordingly, to achieve the above objectives, there is provided an ink delivery system of a liquid electrophotographic color printer for supplying liquid developers of predetermined concentration, each of which is a mixture of a toner and a liquid carrier, to a plurality of developing units, respectively, and for recovering the carrier of a drying/condensing unit which absorbs and evaporates the carrier remaining on the photosensitive medium after development. The ink delivery system comprises a plurality of circulation tanks which store respective developers to be supplied to the developing unit, and comprise respective concentration measuring devices for measuring the concentration of the developers; a waste tank receiving waste developer produced in the plurality of circulation tanks and provided with a waste developer agitating device for agitating the waste developer; a plurality of ink storage tanks which store concentrated inks of predetermined colors to be supplied to the circulation tanks, respectively, and in which respective ink agitators driven by a single driving source are installed; a carrier storage tank which stores a carrier to be supplied to the circulation tank, and is provided with an inclined surface at the bottom so that water and a liquid carrier condensed by the drying/condensing unit can be stored in a stratified state; a refill cartridge storing a concentrated ink or carrier with compressed air and removably installed at a common installation portion provided at the main body of the printer; and a developer refilling/waste recovering mechanism which refills a concentrated ink or carrier of the refill cartridge into a corresponding ink storage tank or carrier storage tank and recovers the waste developer stored in the waste tank to an empty refill cartridge.

Here, the developer refilling/waste recovering mechanism comprises: a sensing unit for recognizing the identity of the refill cartridge installed at the installation portion; a valve unit at which a plurality of valves are installed to be selectively aligned with the refill cartridge and which is installed to be movable with respect to the main body of the printer; and a valve raising/lowering mechanism which raises or lowers the valve unit with respect to the main body of the printer so that the valve aligned with the refill cartridge can be connected to or separated from the refill cartridge.

In addition, the developer refilling/waste recovering mechanism further comprises a fastener for fixing the refill cartridge installed at the installation portion to the main body of the printer.

Here, the fastener comprises: a cap installed at the refill cartridge to surround a discharge hole of the refill cartridge, and provided with an engagement portion; lockers installed at a main frame of the main body of the printer to be movable so as to be engaged with the engagement portion; locker moving portions for moving respective lockers with respect to the main frame.

In this system, the main body of the printer comprises the main frame provided with the installation portion, and an auxiliary frame installed to be vertically movable with respect to the main frame; and the valve unit comprises: a slider at which the plurality of valves which can selectively be aligned with the discharge hole are installed at predetermined positions, and which is installed to be horizontally movable with respect to the auxiliary frame; and a slider moving mechanism horizontally moving the slider with respect to the auxiliary frame.

Here, the slider moving mechanism comprises: a pair of guide rods installed at the auxiliary frame; slider supporters installed at the slider so as to be assembled to the pair of guide rods; a slider pinion installed at the auxiliary frame to mesh with a slider rack portion provided in a lengthwise direction of the slide to be rotated; and a slider driving motor installed at a slider bracket installed at the auxiliary frame for driving the slider pinion.

In this system, the plurality of valves includes at least three valves, which are composed of a concentrated ink valve for refilling a concentrated ink stored in the refill cartridge into the printer, a carrier valve for refilling a carrier stored in the refill cartridge into the printer, and a waste developer valve connected to a waste developer passage in the waste tank.

In this system, a sensing unit senses whether the refill cartridge stores a concentration ink or carrier, and, when the refill cartridge stores a concentrated ink, senses the color of the concentrated ink.

In addition, the concentration measuring device comprises: a housing which includes a developer supplying portion and a concentration measuring portion which are provided so that the developer enters into or exits from the portions, and is filled with the developer to a predetermined level; a rotating roller which is installed at the concentration measuring portion of the housing so that a portion of the rotating roller can be immersed in the developer, and on the surface of which a developer film is formed when the rotating roller rotates; a driving source for driving the rotating roller; and a sensor means for emitting a light beam to the developer film, receiving the reflected light beam after passing through the developer film, and measuring the concentration of the developer.

The waste tank comprises: a main body provided with a cylindrical agitation portion formed to be projected from the bottom thereof; a waste developer discharge port formed at the center of the cylindrical agitation portion; and a jet orifice formed at the side wall of the cylindrical agitation portion so as to jet the mixed waste discharged through the waste developer discharge port toward the cylindrical agitation portion.

The waste tank further comprises: a pump installed on the passage between the waste developer discharge port and the jet orifice so that the waste developer discharged from the waste developer discharge port can be jetted into the cylindrical agitation portion through the jet orifice; and a two-way valve installed on the passage between the pump and the jet orifice so as to selectively cause the waste developer discharge port to communicate with the jet orifice.

In this system, the ink storage tank comprises: a belt-pulley installed outside the corresponding ink storage tanks so as to drive all the ink agitators; and a driver which drives the belt-pulley means.

The ink agitator comprises: a rotating shaft installed in the ink storage tank in the lengthwise direction of the ink storage tank; a plurality of propellers radially installed at the lower end of the rotating shaft; a cylindrical rib coaxially installed on the rotating shaft so as to connect between the propellers and to form a predetermined suction portion between the cylindrical rib and the rotating shaft; and a base plate installed around the circumferential surface of the rib so as to form a discharge portion between the inner wall of the ink storage tank and the circumferential edge of the base plate by having a shorter radial length than the length of the propeller and allow the space below the base plate to communicate with the suction portion.

The system further comprises: a water sensing sensor installed at the bottom of the carrier storage tank for sensing water in the carrier storage tank; a water discharge pipe installed in the vicinity of the water sensing sensor; and a valve installed on the discharge pipe so as to be selectively opened or closed according to information sensed by the water sensing sensor, and to allow the water to be discharged to the water discharge pipe.

In addition, to achieve the above objectives, there is provided an ink refilling method of a liquid electrophotographic color printer including the steps of: (a) deciding whether necessity of refilling any one of the concentrated inks and the carrier exists; (b) inserting a refill cartridge corresponding to the ink or carrier storage tank requiring a refill into the common installation portion; (c) confirming the identity of the refill cartridge inserted in the installation portion; (d) aligning a corresponding valve of the valves with the discharge hole of the identified refill cartridge; (e) fixing the refill cartridge to the installation portion with the fastener; (f) raising the valve unit by the valve raising/lowering mechanism so as to connect the aligned valve to the discharge hole; (g) rapidly injecting the ink or carrier into the corresponding ink storage tank or carrier storage tank; (h) lowering the valve unit by the valve raising/lowering mechanism; and (i) removing the refill cartridge from the installation portion.

BRIEF DESCRIPTION OF THE DRAWINGS

The above objectives and advantages of the present invention will become more apparent by describing in detail preferred embodiments thereof with reference to the attached drawings in which.

DESCRIPTION OF THE PREFERRED EMBODIMENTS

Figure 1:
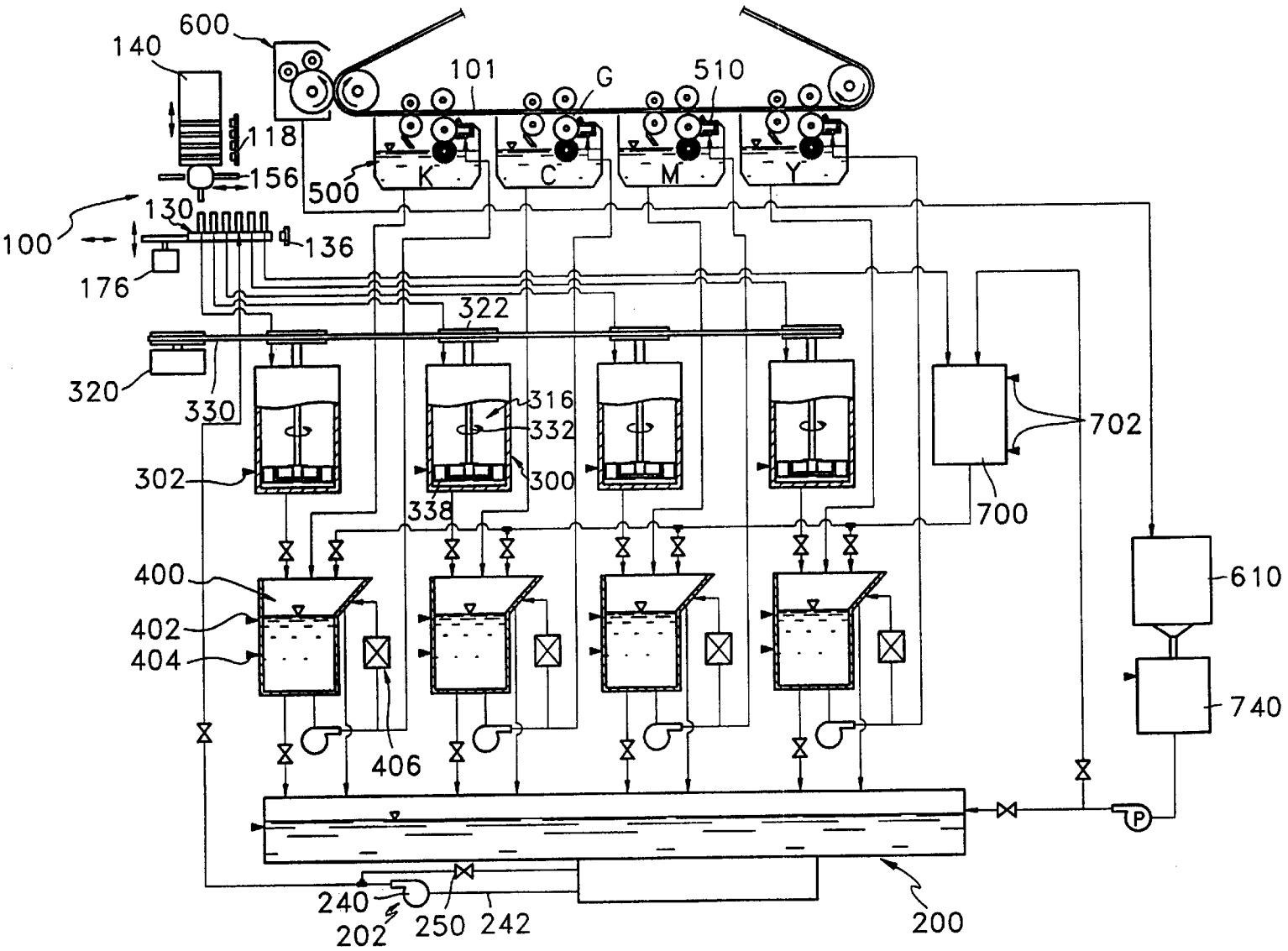
FIG. 1 is a schematic diagram illustrating the structure of an ink delivery system of a liquid electrophotographic color printer according to an embodiment of the present invention.

FIG. 1 is a schematic diagram illustrating the structure of an ink delivery system of a liquid electrophotographic color printer according to a preferred embodiment of the present invention.

Referring to FIG. 1, in this system, developers having predetermined concentration and volume corresponding to respective colors so as to be appropriate for development are stored in circulation tanks 400. The developers are supplied to respective developing units 500 and used to sequentially develop respective electrostatic latent images formed on a photosensitive medium 101. Thereafter, a carrier condensed by a drying/condensing unit 600 is recovered to the circulation tanks 400. The system can realize a full color image by using inks of yellow (Y), magenta (M), cyan (C) and black (K) colors.

The system comprises a plurality of circulation tanks 400 for storing respective developers to be supplied to the respective developing units 500, sprayers 510 for spraying the developers in the circulation tanks 400 to developing gaps G of the developing units 500, respectively, a plurality of ink storage tanks 300 for storing concentrated inks corresponding to the colors, a carrier storage tank 700 for storing a carrier to be supplied to the circulation tanks 400, a waste tank 200 for recovering waste developer produced at the circulation tanks 400, a refill cartridge 140 for rapidly injecting a concentrated ink or carrier therein into an ink storage tank 300 or carrier storage tank 700 or recovering waste developer within the waste tank 200 to the refill cartridge 140 when in an empty state, and a developer refilling/waste developer recovering mechanism 100 which refills the concentrated ink or carrier stored in the refill cartridge 140 to an ink storage tank 300 or the carrier storage tank 700 or recovers waste developer within the waste tank 200 to an empty refill cartridge 140.

Upper and lower limit level sensors 402 and 404 are installed at each circulation tank 400 for sensing the level of a developer stored in the circulation tank 400. A concentration measuring device 406 is installed outside each circulation tank 400 for measuring the concentration of the developer. The waste tank 200 is provided with a waste developer agitating device 202 for agitating waste developer contained in the waste tank 200. Ink agitators 316 driven by one driving source 320 are installed in the respective ink storage tanks 300. An inclined surface is formed at the bottom of the carrier storage tank 700 so that water and a liquid carrier condensed by the drying/condensing/unit 600 can sequentially be stored in a separated state.

Figure 2:
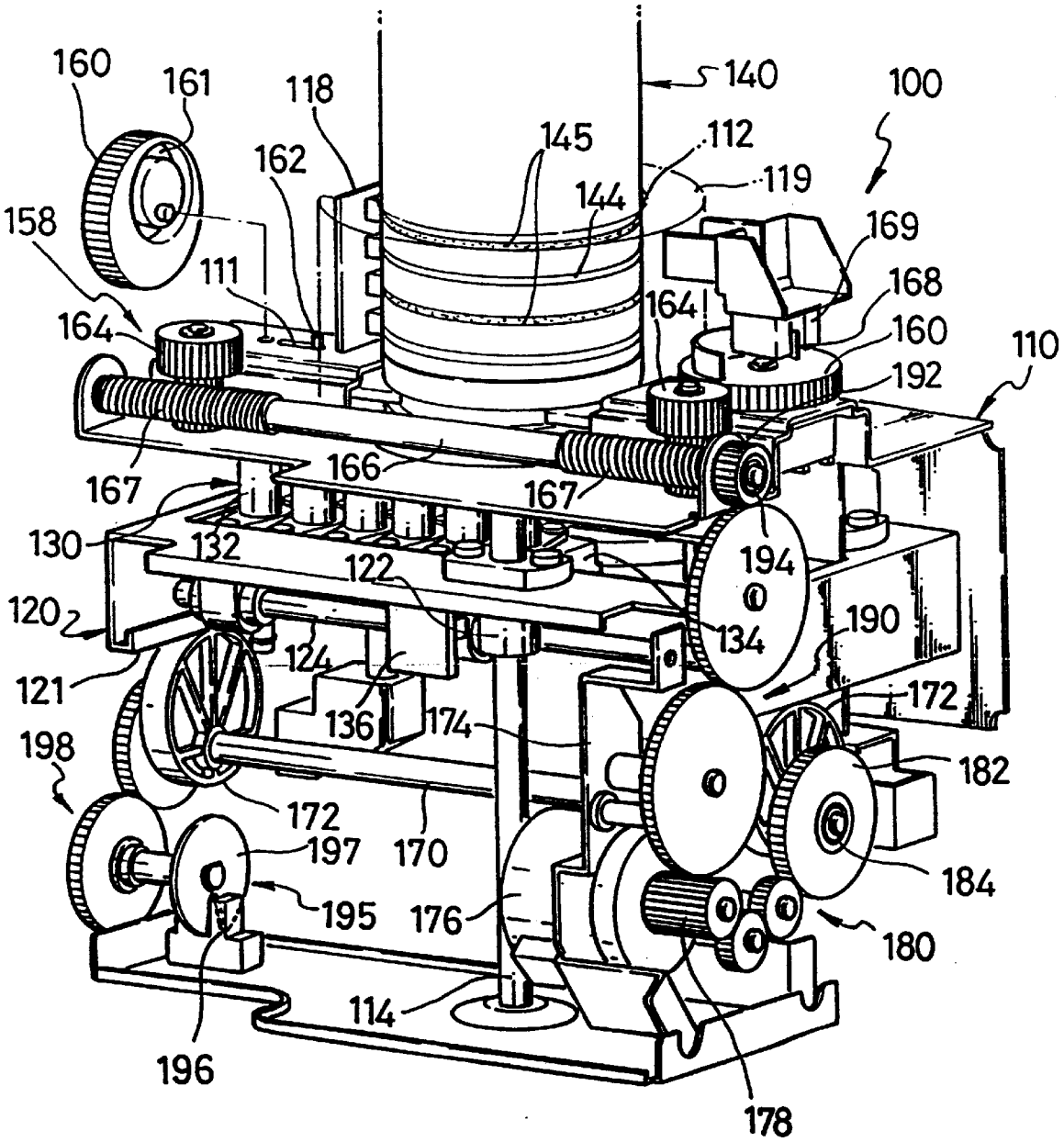
FIG. 2 is a perspective view schematically illustrating the portion of a developer refilling/waste recovering mechanism of FIG. 1.

As shown in FIG. 2, the developer refilling/waste developer recovering mechanism 100 comprises a main frame 110, an auxiliary frame 120 being vertically movable with respect to the main frame 110, a valve unit 130 being horizontally movable with respect to the auxiliary frame 120, a common installation portion 112 formed at the main frame 110 so that a refill cartridge 140 can be installed, a fastener 150 (FIG. 4) for fastening the refill cartridge 140 to the installation portion 112, and a valve raising/lowering mechanism which moves the valve unit 130 vertically.

A plurality of guide shafts 114 are vertically installed vertically at the main frame 110. Guide flanges 122 are installed around the guide shafts 114. The guide flanges 122 are fixed to the auxiliary frame 120 and guide the vertical movement of the auxiliary frame 120 with respect to the main frame 110.

Figure 3:
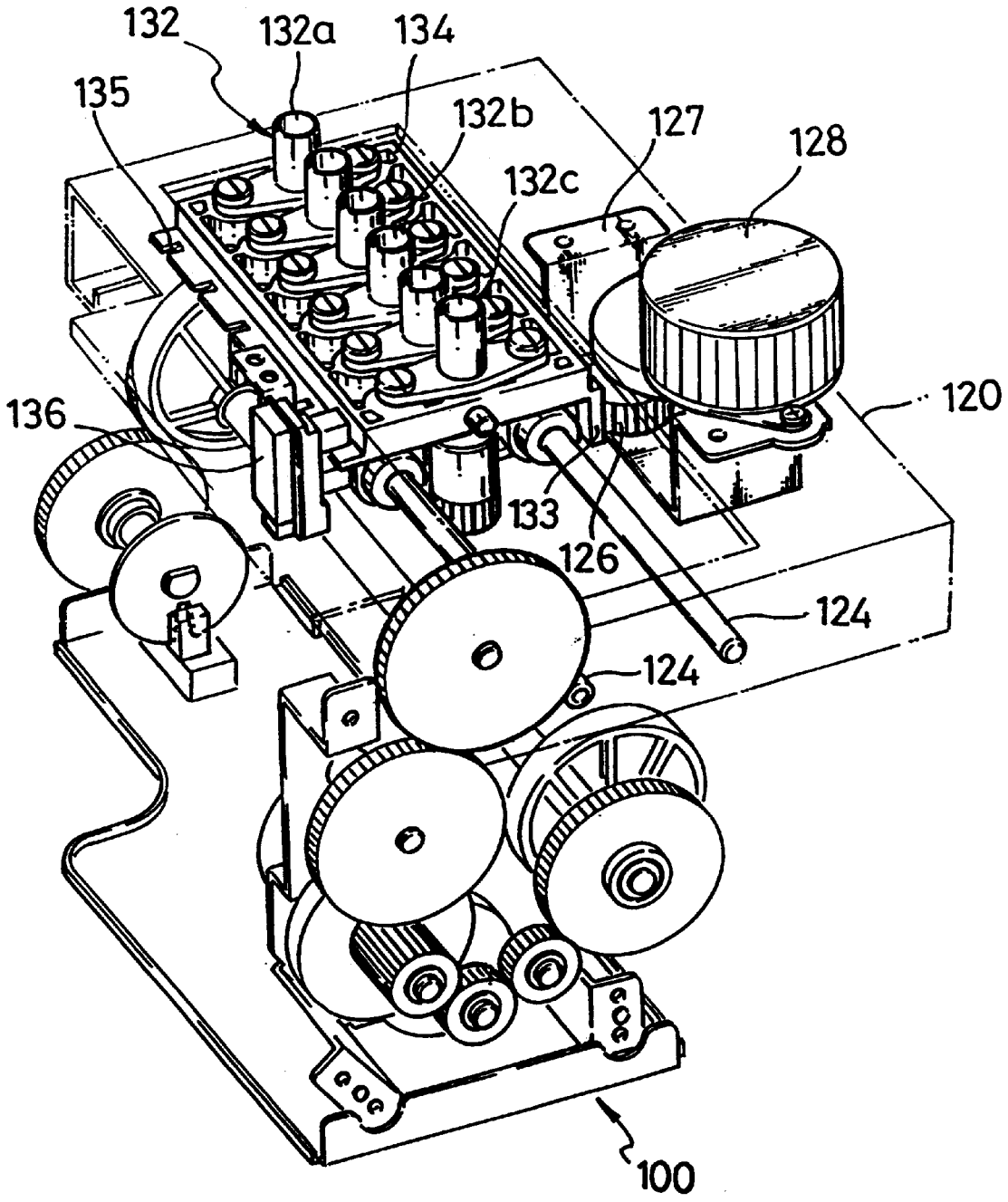
FIG. 3 is a perspective view schematically illustrating a slider portion of FIG. 2.

As shown in FIGS. 2 and 3, the valve unit 130 comprises a slider 134 on which a plurality of valves 132 are installed linearly, and a slider moving mechanism which moves slider 134. The slider 134 is moved horizontally with respect to the auxiliary frame 120 so as to selectively align one of the valves 132 with a discharge hole 142 (FIG. 4) of the refill cartridge 140 installed at the installation portion 112. The valves 132 are comprised of four ink supplying valves 132*a*, one carrier supplying valve 132*b*, and one waste developer valve 132*c* and are disposed at predetermined positions. It is preferable that well-known quick valves are used as the valves 132.

The slider moving mechanism comprises a pair of guide rods 124 which are installed at the auxiliary frame 120 and on which the slider 134 is assembled, a slider rack portion 133 formed in a lengthwise direction of the slider 134, a slider pinion 126 meshing with the slider rack portion 133 to be rotated, a slider bracket 127 installed on the auxiliary frame 120, and a slider driving motor 128 installed at the slider bracket 127. It is preferable that a known stepper motor is used as the slider driving motor 128.

The slider 134 is set to be moved a predetermined length by the rotation of a predetermined number of degrees of the slider driving motor 128. In addition, the system is provided with a slider position sensor which enhances the precision of alignment by precisely sensing the centers of the valves 132. The slider position sensor comprises slider mark portions 135 formed in a lengthwise direction of the slider 134 a slider position sensor 136 installed at the auxiliary frame 120 for sensing the slider mark portions 135.

The refill cartridge 140 is a concentrated ink or carrier refill cartridge having the same specifications, but, the content of the cartridge may be one of the concentrated inks of four colors or a carrier. Since compressed air is stored in the refill cartridge 140 together with the content thereof, when the valve unit 130 is raised and the valve 132 presses the discharge hole 142 (FIG. 4), the carrier or concentrated ink stored in the refill cartridge 140 is rapidly discharged from the cartridge 140 due to the pressure via the discharge hole 142.

This system 100 is provided with a sensing unit for recognizing whether the cartridge 140 stores a concentrated ink or the carrier, and whether the cartridge is an empty cartridge or an imitation which cannot be applied to this system.

Figure 4:
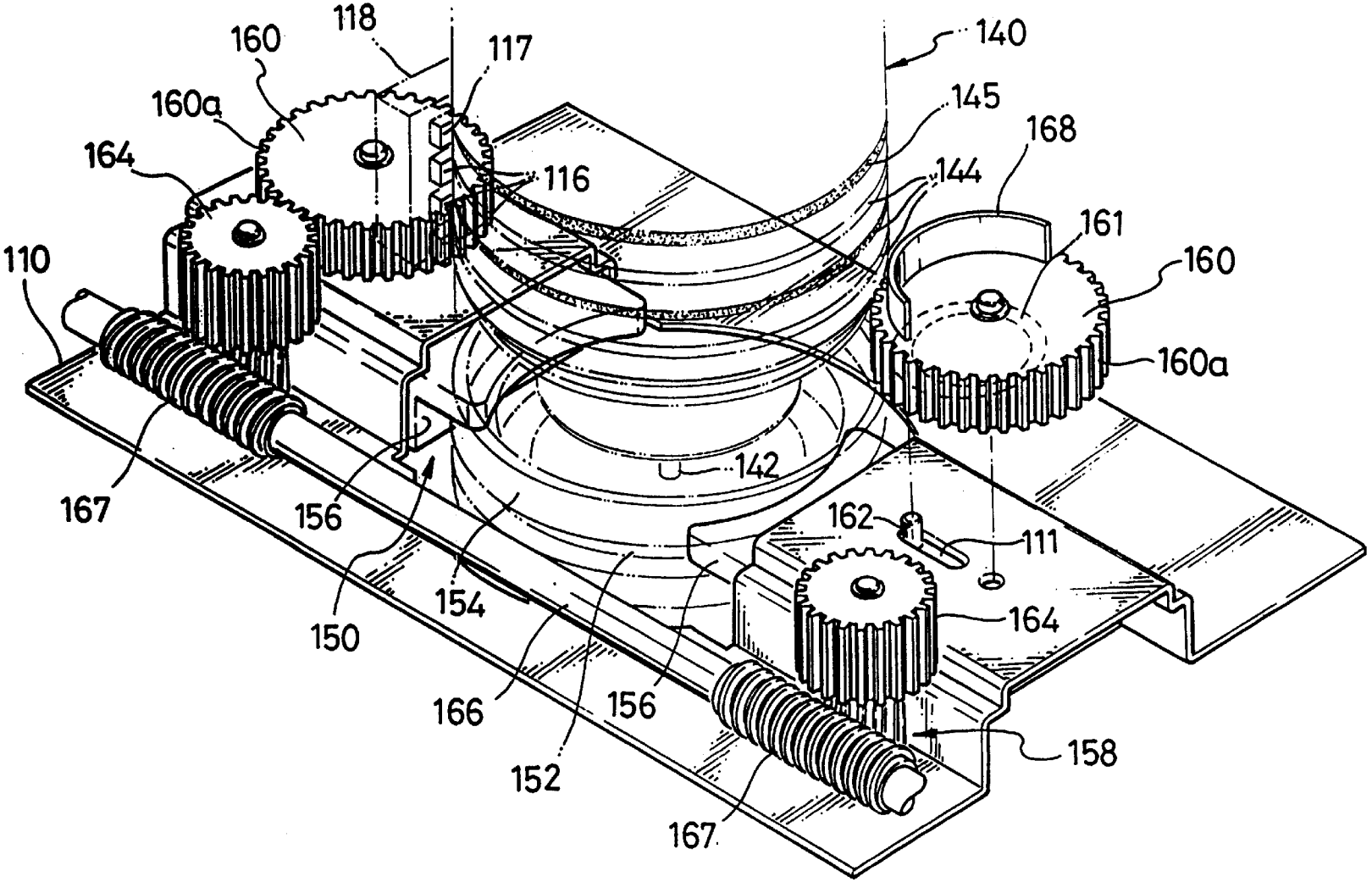
FIG. 4 is a perspective view schematically illustrating a fastener portion of FIG. 2.

As shown in FIG. 4, the sensing unit includes four lustrous line mark portions 144 provided at predetermined positions of the surface of the cartridge 140 which are treated to be lusterless so that lustrous lines 145 can be marked at four different positions according to the identity of the content of the cartridge 140, and a sensor block 118 provided with sensors 116 installed at positions corresponding to the lustrous line mark portions 144.

The sensors 116 first recognize whether the content of the cartridge 140 is a carrier or a concentrated ink according to the combination of whether each of the lustrous lines 145 marked in the lustrous line mark portions 144 exists or not, and the positions of the lustrous lines 145. Then the sensors 116 recognize the color of the concentrated ink if a concentrated ink is store in the cartridge 140. Here, one of the sensors 116 is a spare sensor 117 for replacing a malfunctioning sensor when one of the sensors 116 malfunctions.

An example of the logic structure of a system controlling portion in which the sensors 116 confirm the identity of the cartridge 140 according to the combination of whether each of the lustrous lines 145 exists or not, and the positions of the lustrous lines 145, is shown in the following Table 1. According to Table 1, the identity of the cartridge 140 can be determined by only three sensors, and in addition, even if one of the sensors 116 malfunctions, the identities of five cartridges 140 can be recognized by the spare sensor 117. For example, when sensors 1 and 2 are "on', and sensors 3 and 4 are "off", the content of the cartridge 140 is recognized as a concentrated ink of a yellow color.

TABLE 1

| | | | | | |
|---|---|---|---|---|---|
| Sensor 1 | on | on | off | off | off |
| Sensor 2 | on | off | on | on | off |
| Sensor 3 | off | on | on | off | on |
| Sensor 4 | off | off | off | on | on |
| Result | yellow | magenta | cyan | black | carrier |

As shown in FIGS. 2 and 4, the installation portion 112 is formed on the main frame 110, a cartridge guide 119 is installed around the installation portion 112 so as to guide a refill cartridge 140 inserted in the installation portion 112. The sensor block 118 is installed at the cartridge guide 119.

Figure 5:
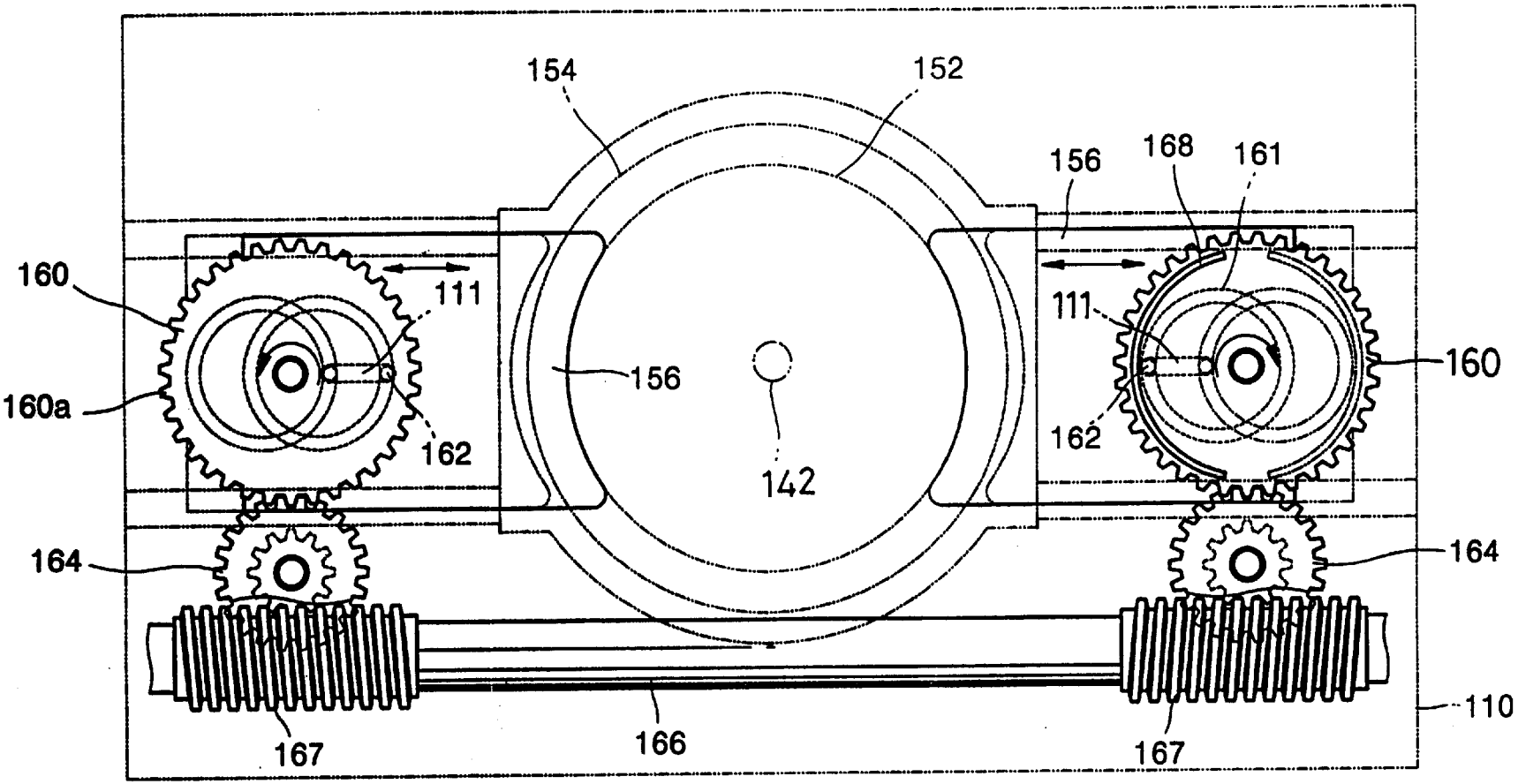
FIG. 5 is a perspective view schematically illustrating a locker portion of FIG. 4.

As shown in FIGS. 4 and 5, the fastener 150 comprises a cap 154 installed at the leading end of the refill cartridge 140 around the discharge hole 142, an engagement portion 152 formed around the outer circumference of the cap 154, a pair of lockers 156 installed at both sides of the installation portion 112 to be inserted into the engagement portion 152, and locker moving portions 158 for moving the lockers 156 with respect to the main frame 110, respectively.

Each locker moving portion 158 comprises a locker cam 160, a cam pole 162, a worm gear, and a worm driving means. The worm gear is comprised of a worm wheel 164 and a worm 166. The locker cam 160 is rotatably installed at both sides of the main frame 110. A cam groove 161 of a predetermined shape is formed at the lower surface of the locker cam 160, and a locker cam gear 160*a* is formed at the outer circumference of the locker cam 160. The cam pole 162 is installed at the locker 156 so as to pass through an elongated locker hole 111 formed at the main frame 110. One end of the cam pole 162 is inserted into the cam groove 161. A pair of worm portions 167 are installed at the ends of the worm 166. Spiral threads are symmetrically formed at the worm portions 167. Therefore, when the worm 166 rotates, the pair of locker cams 160 are rotated in directions opposite to each other, and the cam poles 162 are moved to be close to or far away from each other with respect to the elongated locker holes 111. Then, the pair of lockers 156 installed symmetrically can approach or be separated from each other with reference to the discharge hole 142. The worm moving means will be described later.

As shown in FIGS. 2 and 4, a locker position sensing means for sensing whether the cap 154 and the locker 156 are engaged with or disengaged from each other comprises a semicircular projection member 168 installed to be projected on the locker cam 160, and a locker cam sensor 169 installed at the cartridge guide 119 of the main frame 110 so as to respond according to the rotational position of the projection member 168. The locker cam sensor 169 is a usual reflected light sensor.

Figure 6:
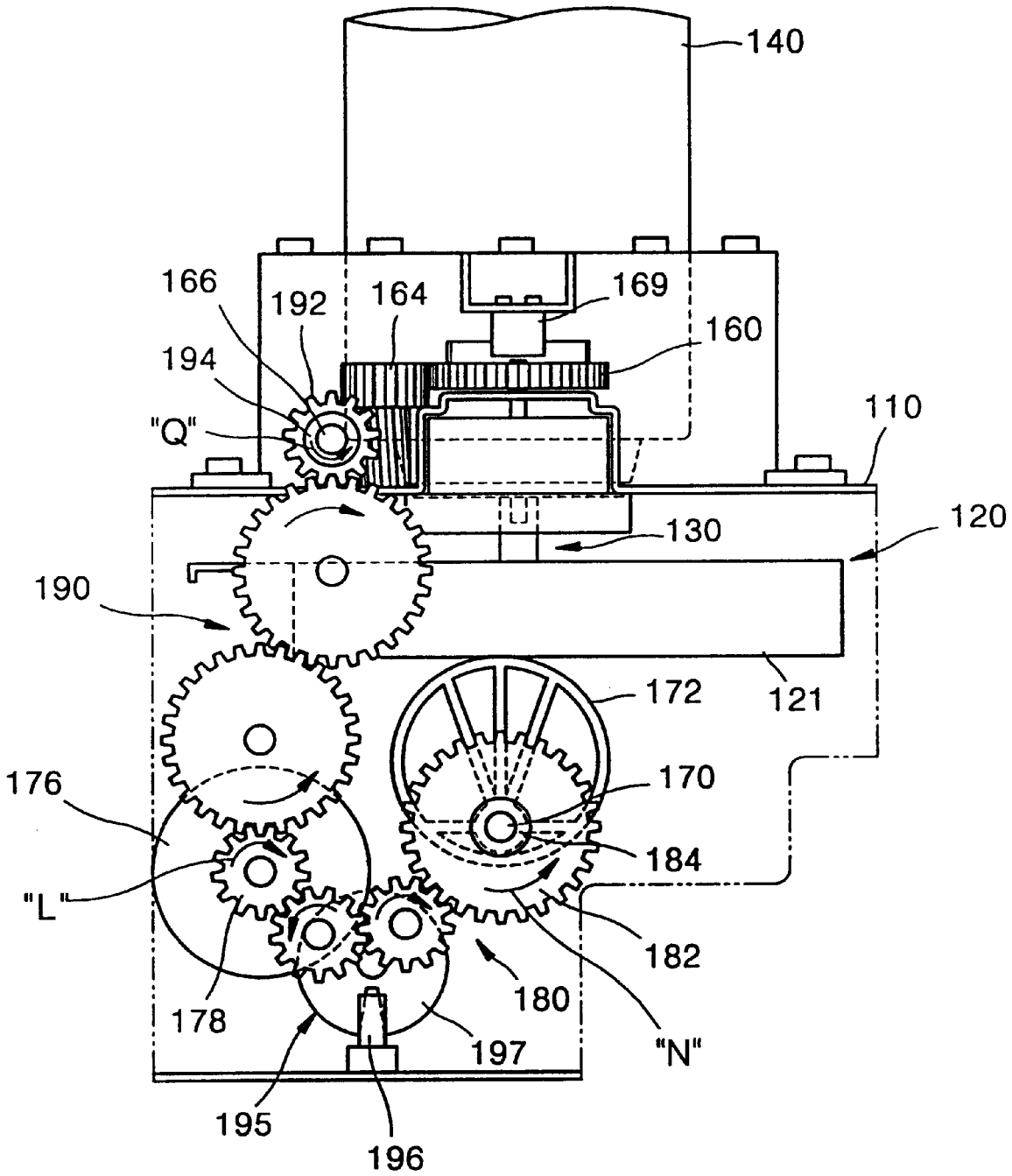
FIG. 6 is a side view for describing the operation of the developer refilling/waste recovering mechanism of FIG. 2.
Figure 7:
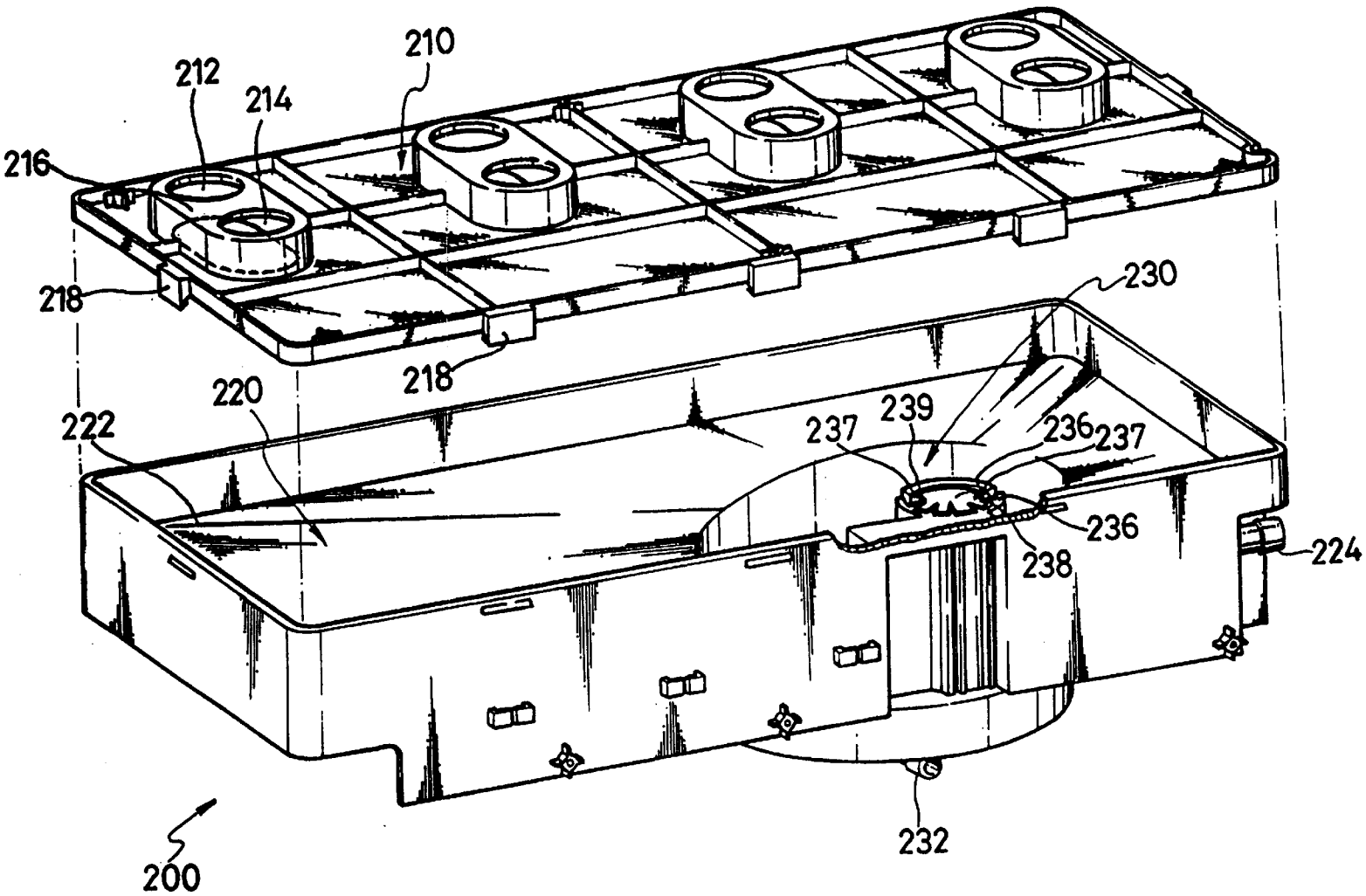
FIG. 7 is an exploded perspective view schematically illustrating a waste tank portion of FIG. 1.

As shown in FIG. 6, the valve raising/lowering mechanism comprises slider supporters 121 formed at the auxiliary frame 120, a cam shaft 170 installed at the main frame 110, cam members 172 installed on the cam shaft 170, and a cam driving portion for rotating the cam shaft 170. The slider supporters 121 are formed at both ends of the auxiliary frame 120 to be projected downward, and each of the slider supporters 121 has a contact portion contacting the cam member 172. The cam shaft 170 is installed at the main frame 110, and the cam member 172 has a predetermined cam shape to contact the contact portion.

The cam driving portion comprises a cam driving motor 176 installed at a cam driving motor bracket 174 installed at the main frame 110, and a first power transfer system 180 connecting the cam shaft 170 and the cam driving motor 176.

The cam driving motor 176 additionally performs the function of the above-described worm driving means. Therefore, the system 100 comprises double power transfer systems, that is, the first power transfer system 180 for rotating the cam member 172 and a second power transfer system 190 for rotating the worm 166.

The first power transfer system 180 comprises a first gear 178 installed on the rotating shaft of the cam driving motor 176, a second gear 182 installed on one end of the cam shaft 170, and a first train of gears installed between the first gear 178 and the second gear 182. The second power transfer system 190 comprises the first gear 178, a third gear 192 installed on the shaft of the worm 166, and a second train of gears installed between the first gear 178 and the third gear 192. Here, a first one-way bearing 184 is installed between the second gear 182 and the cam shaft 170, and a second one-way bearing 194 is installed between the third gear 192 and the worm 166. The one-way bearings 184 and 194 are intended to selectively rotate the cam shaft 170 or the worm 166 according to the rotation or reverse rotation of the cam driving motor 176.

On the other hand, the valve unit position sensing portion 195 for sensing the vertical position of the auxiliary frame 120 moving vertically with respect to the main frame 110 comprises a valve unit position sensor 196 installed at the main frame 110, and a marking member 197. It is preferable that the marking member 197 is a disc member in which a slit is formed at a predetermined position thereof so that the position of the upper and lower portions of the auxiliary frame 120. In addition, the marking member 197 is installed to be moved simultaneously by a train of gears 198 installed at the main frame 110, and therefore to be rotated by the cam shaft 170. The valve unit position sensor 196 is positioned on the rotational track of the marking member 197, and senses the vertical position of the auxiliary frame 120 according to the passage of the slit. A known reflected light sensor is used as the valve unit position sensor 196.

As shown in FIG. 1, and FIGS. 7 through 9, the waste tank 200 comprises a cover 210 and a main body 220. Four waste developer inflow portions 216 corresponding to yellow, magenta, cyan, and black colors are provided on the cover 210, and each waste developer inflow portion 216 is provided with a pair of first and second inflow ports 212 and 214. The first and second inflow ports 212 and 214 are passages through which waste developer recovered from a circulation tank 400 or a developer overflowing from a circulation tank 400. A plurality of elastic pieces 218 are provided at the rim of the cover 210. The elastic pieces 218 are elastically assembled to the upper rim of the main body 220.

Figure 8:
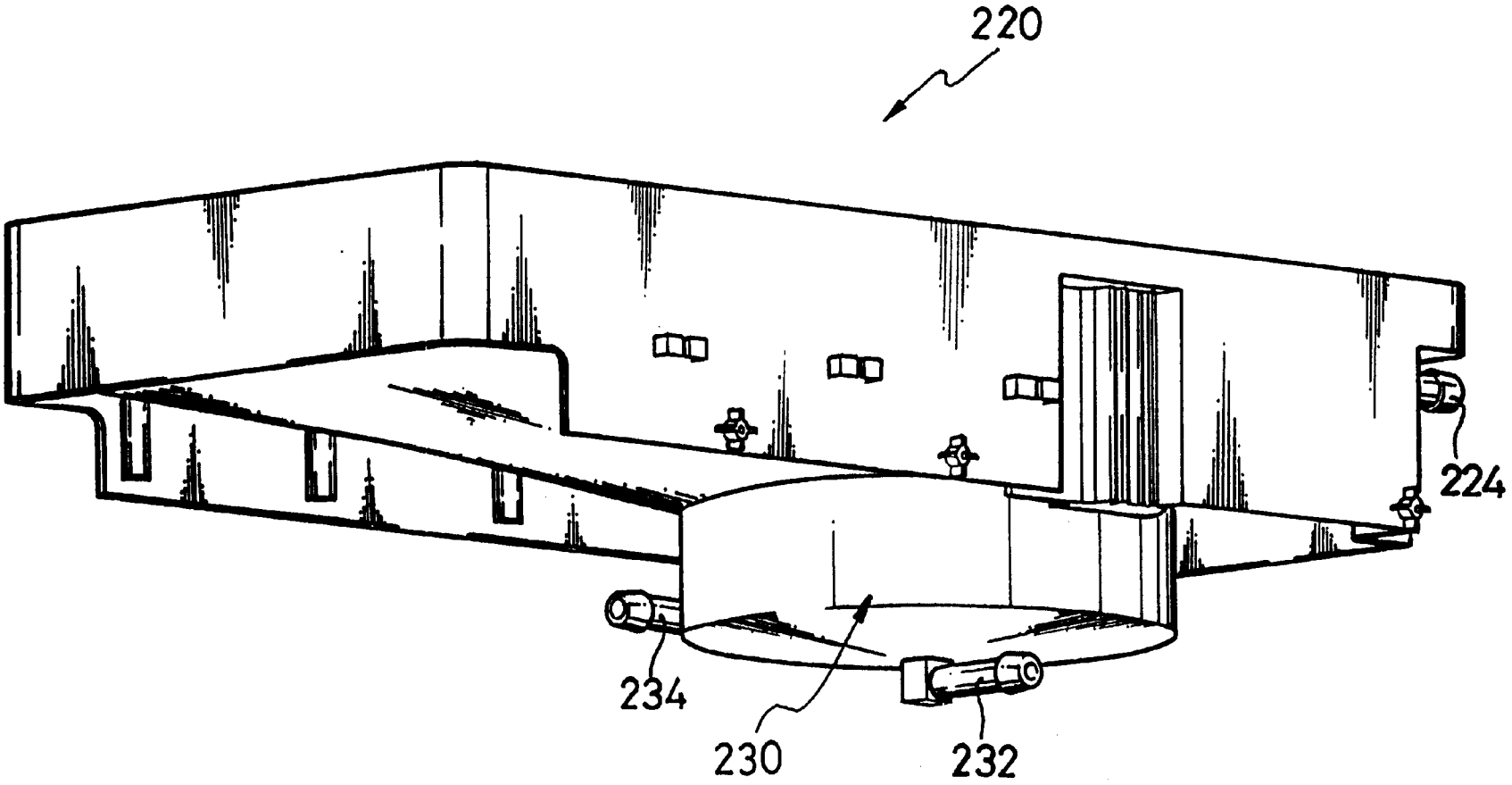
FIG. 8 is a bottom perspective view schematically illustrating a cylindrical agitation portion of FIG. 2.

The main body 220 contains waste developer and overflowing developers flowing in through the waste developer inflow portions 216. In particular, since toner constituents are contained in waste developer, the main body 220 must have a structure of facilitating agitation. To this end, an inclined surface 222 is formed at the bottom of the main body 220, a cylindrical agitation portion 230 is projected from the lower end portion of the inclined surface 222. As shown in FIG. 8, a waste developer discharge port 232 is formed at the center of the cylindrical agitation portion 230. An inclined surface which is more inclined as it goes from the side wall to the waste developer discharge port 232 is formed at the cylindrical agitation portion 230. In the waste tank 200, a jet orifice 234 is formed at the side wall of the cylindrical agitation portion 230 so as to agitate the waste developer stored in the waste tank 200 by circulating waste developer discharged through the waste developer discharge port 232 into the cylindrical agitation portion 230. A cylindrical guide member 236 is installed at the side wall of the cylindrical agitation portion 230. A plurality of projections 237 are formed at the inner circumference of the guide member 236. A floater 238 is positioned in the inner space of the guide member 236. The floater 238 senses the level of the waste developer stored in the waste tank 200. In addition, guide grooves 239 into which the guide projections 237 can be inserted are formed at the floater 238. Since the main body 220 is made of a transparent plastic material, the position of the floater 238 can be recognized by the naked eye.

A recovery pipe 224 is provided at the upper portion of the main body 220. The recovery pipe 224 is intended to recover moisture condensed by a condenser 610 (FIG. 16) of a drying/condensing unit 600 to the waste tank 200, and will be described in detail later.

Figure 9:
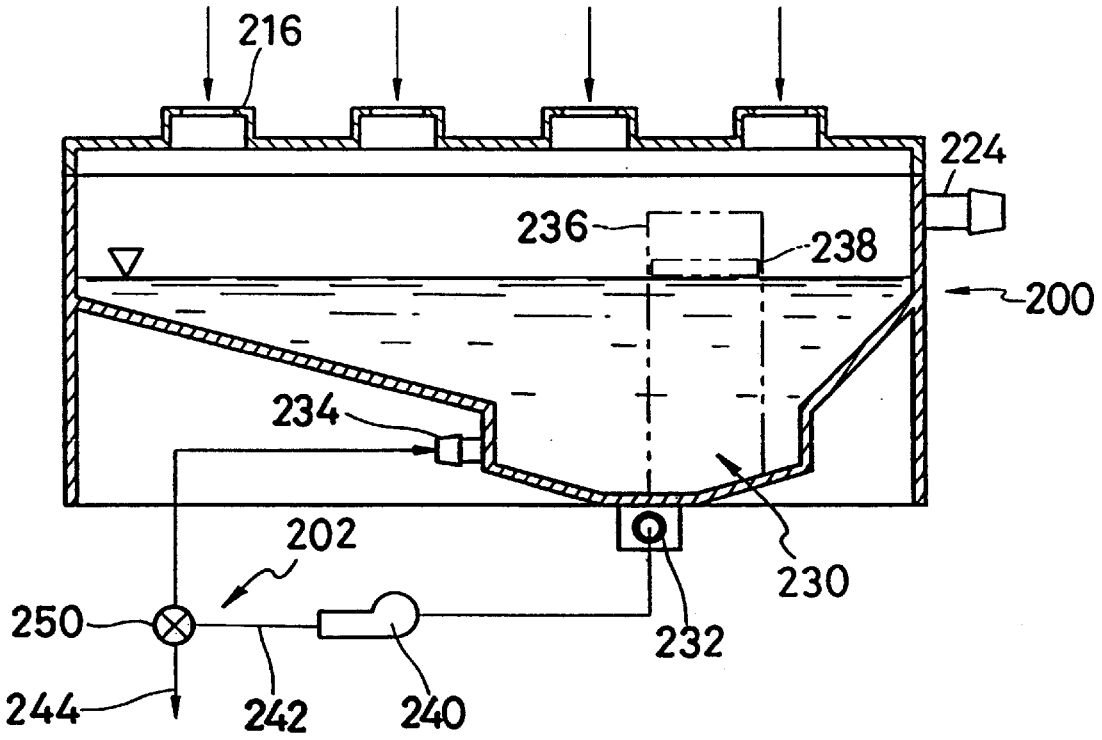
FIG. 9 is a schematic diagram illustrating an agitating device of the waste tank of FIG. 7.

As shown in FIG. 9, the agitating device 202 of the waste tank 200 comprises a first passage 242 connecting the waste developer discharge port 232 with the jet orifice 234, and a waste pump 240 and a two-way valve 250 which are installed on the first passage 242.

A known gear pump is used as the waste pump 240. In addition, the waste pump 240 is originally intended to supply mixed wastes to an empty refill cartridge through a waste developer passage 244. Here, the mixed wastes are a mixture of waste developer or overflowing developers flowing into the waste tank 200 through the waste developer inflow portions 216 and water supplied through the recovery pipe 224. However, the waste pump 240 is also used to agitate the content of the waste tank 200 by selectively opening or closing the two-way valve 250.

The two-way valve 250 is a known electronic valve positioned between the waste pump 240 and the jet orifice 234. The two-way valve 250 is operated to allow the waste developer discharge port 232 to communicate with the jet orifice 234 when the content of the waste tank is agitated, and otherwise operated to close the first passage 242 and to open the waste developer passage 244.

Figure 10:
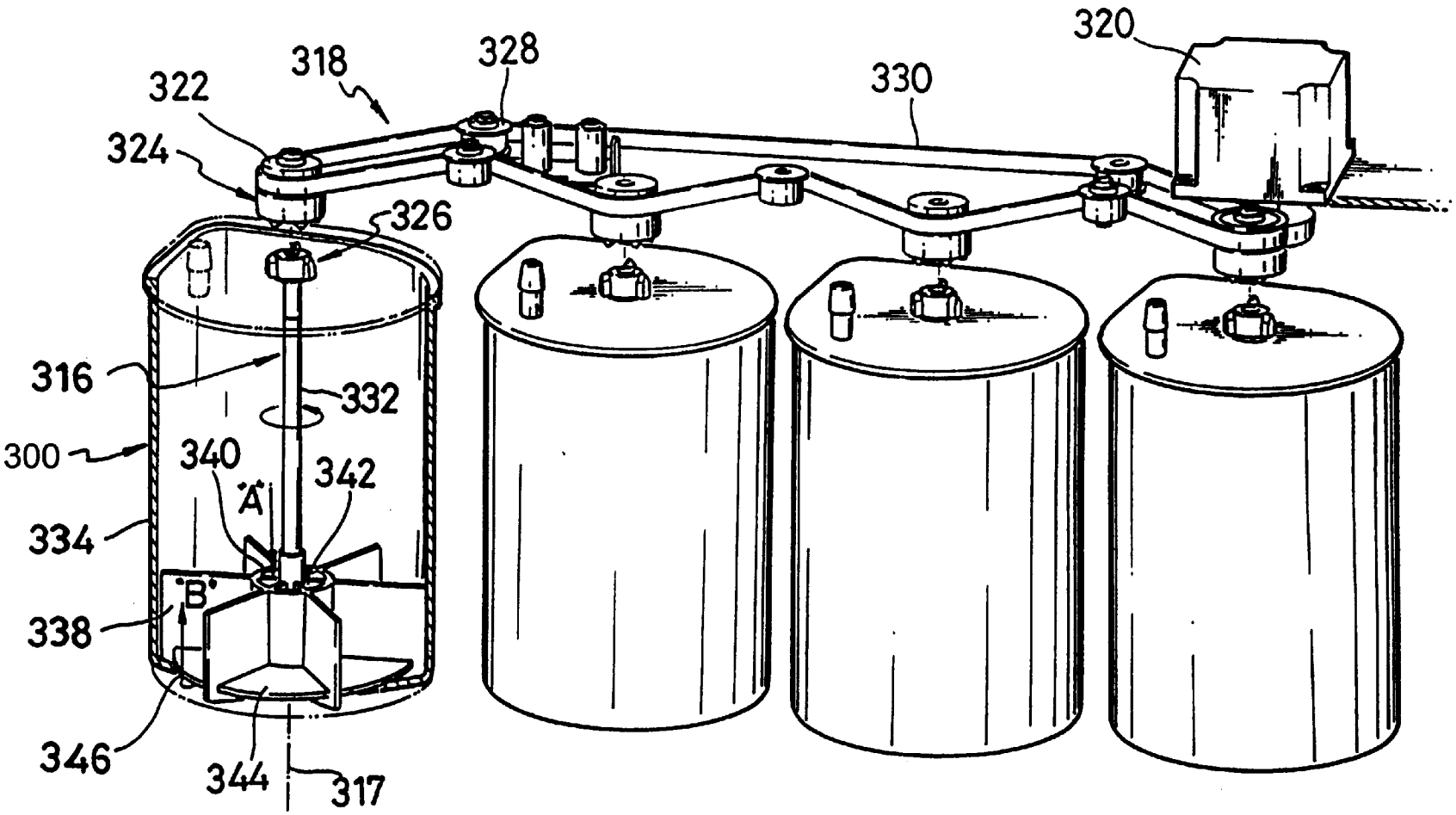
FIG. 10 is an exploded perspective view schematically illustrating ink tanks and an ink agitator of an ink tank of FIG. 1.

As shown in FIGS. 1 and 10, the ink delivery system comprises a belt-pulley 318 rotating the ink agitators 316, and a single driving source 320. That is, since the power of the single driving source is transferred to the ink agitators 316 via the belt-pulley 318, the contents of the four ink storage tanks 300 are simultaneously agitated. A driving pulley 322 is installed at the upper portion of each ink storage tank 300 to be coaxially positioned at the rotation axis 317 of the ink agitator 316. A driving coupler 324 is installed at the driving pulley 322. The driving coupler 324 is connected to a driven coupler 326 installed at the upper portion of the ink storage tank 300. The driving coupler 324 transfers the rotational force of the driving pulley 322 to the ink agitator 316. Idle pulleys 328 are installed between the driving pulleys 328. A driving belt 330 circulating around a continuous loop path is wound around the driving pulleys 322 and the idle pulleys 328. The single driving source 320 is a usual electric motor installed to rotate any one of the driving pulleys 322. The driven coupler 326 is installed on the rotating shaft 332 of each ink agitator 316.

Figure 11:
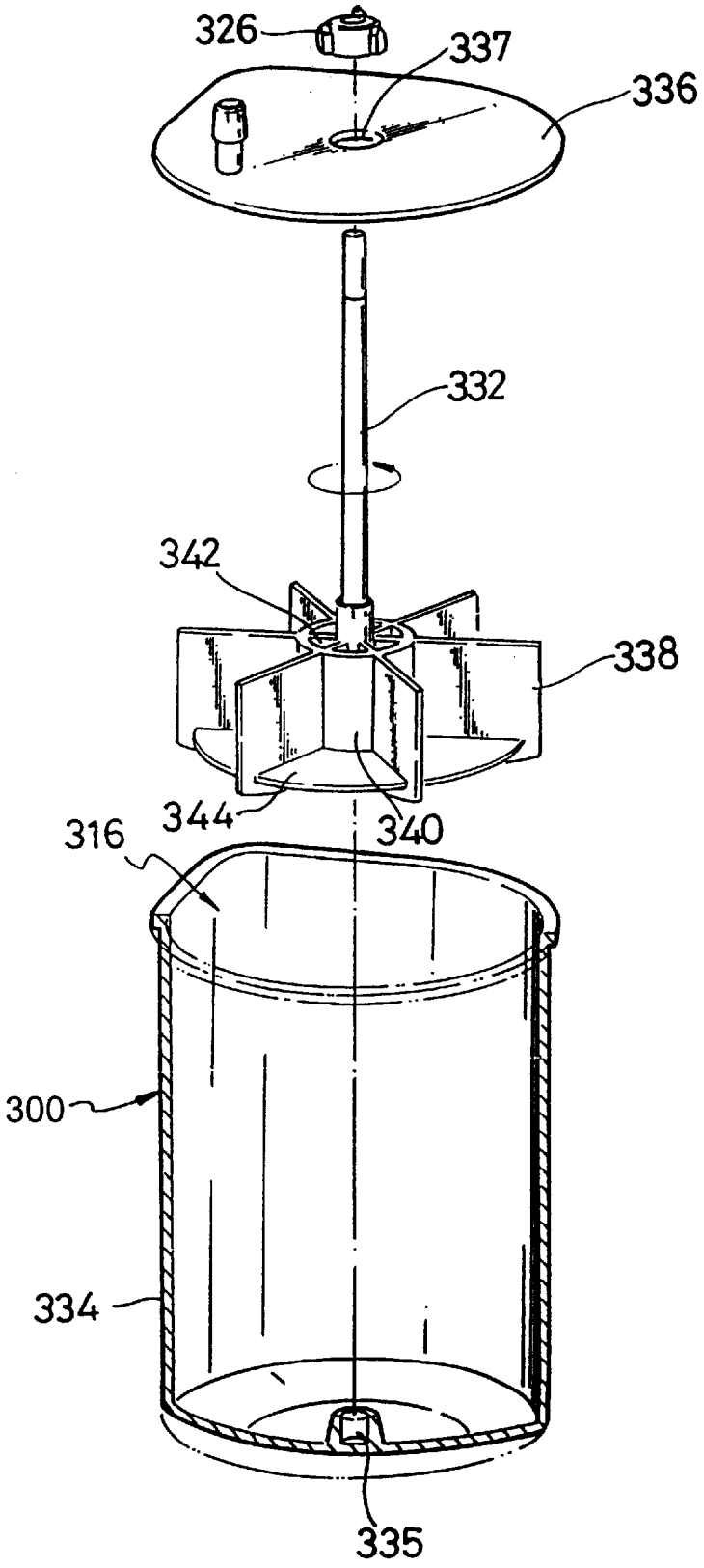
FIGS. 11 through 13 are exploded perspective views illustrating various variations of the ink agitator of FIG. 10.
Figure 12:
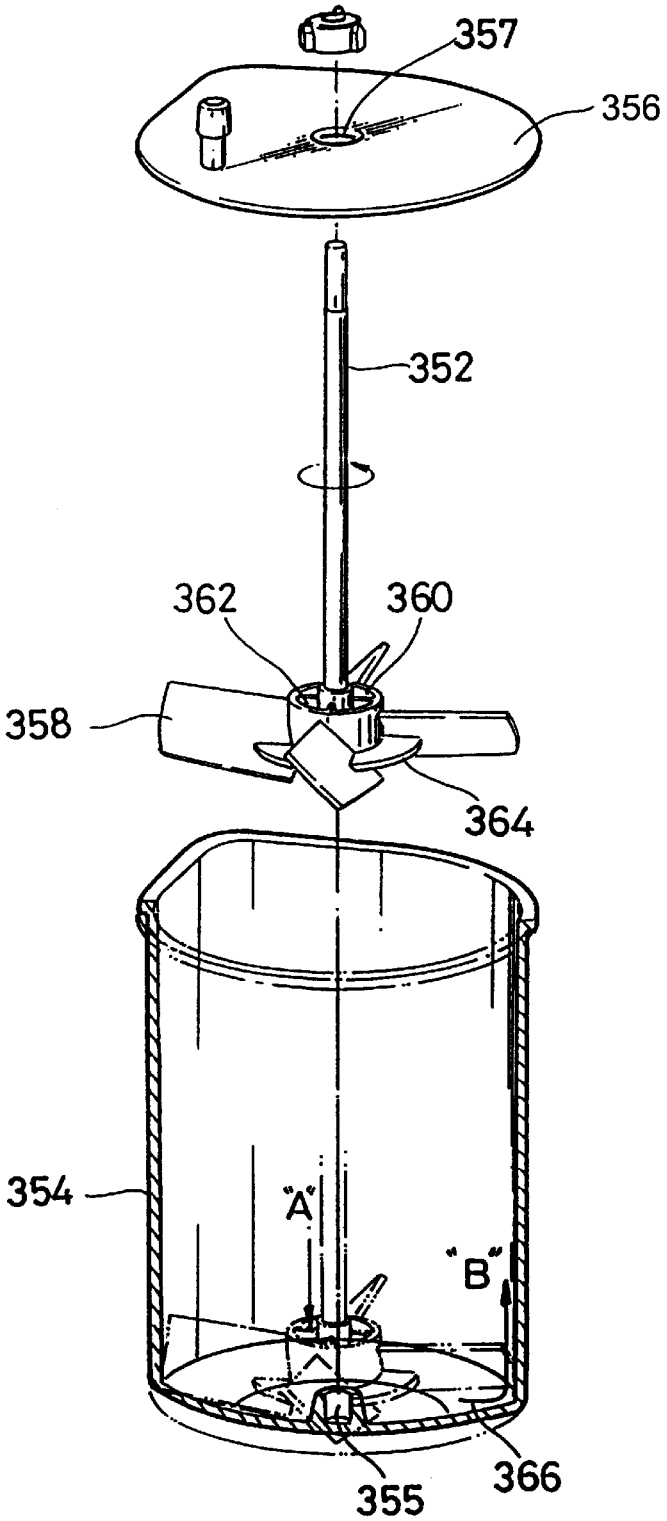
Figure 13:
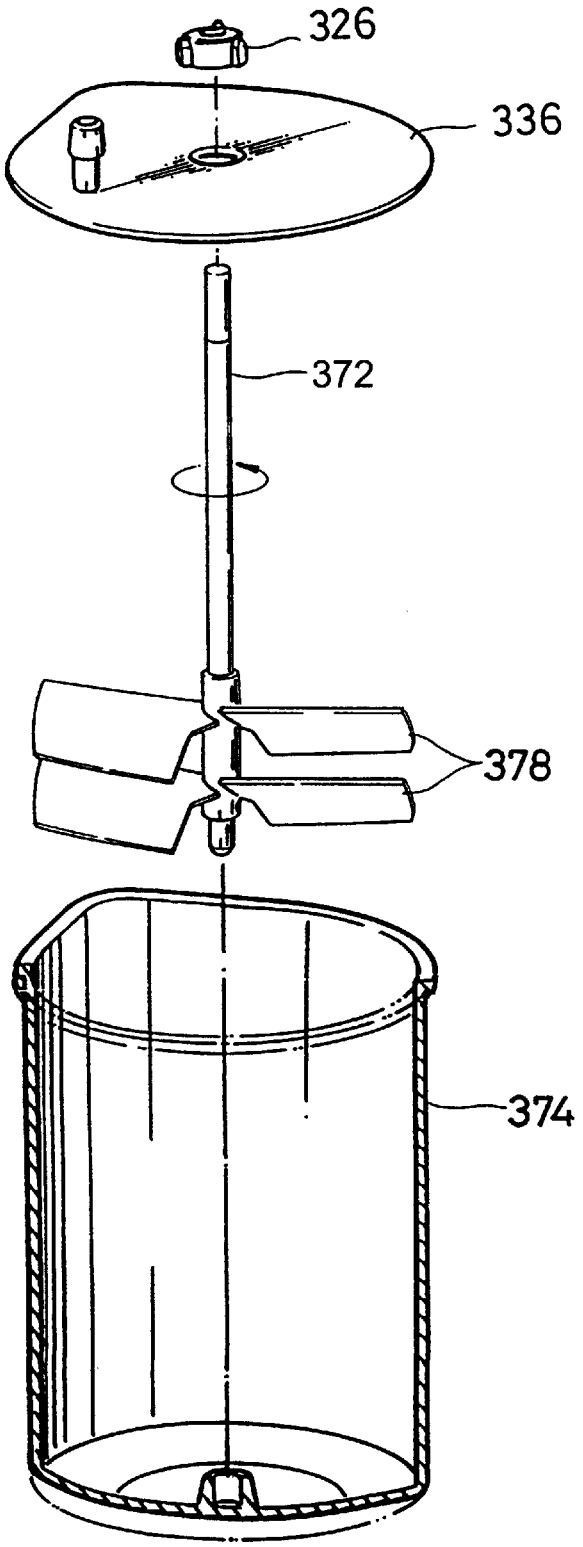

Other embodiments of the ink agitator are shown in FIGS. 11 through 13.

As shown in FIG. 11, a rotating shaft 332 is rotatably installed in a tank main body 334 of each ink storage tank 300. The ink storage tank 300 comprises the tank main body 334 and a cap 336 assembled to the upper portion of the tank main body 334. An installation hole 335 into which one end of the rotating shaft 332 is inserted is formed at the bottom of the tank main body 334. A through hole 337 through which the other end of the rotating shaft 332 can pass is formed at the center of the cap 336. A driven coupler 326 is installed at the other end of the rotating shaft 332 which passes through the through hole 337.

A plurality of propellers 338 are radially installed on the rotating shaft 332. The propellers 338 are installed to be spaced about 1 mm from the inner wall of the tank main body 334. This space is intended for the outer ends of the propellers 338 not to interfere with the inner wall of the tank main body 334 when the propellers 338 rotate. The propellers 338 are connected to the rotating shaft 332 by a cylindrical rib 340 coaxially installed on the rotating shaft 332. A suction portion 342 is formed between the inner circumferential surface of the cylindrical rib 340 and the rotating shaft 332 so that a concentrated ink fluctuated during the rotation of the rotating shaft 332 and the propellers 338 can be sucked along the direction of arrow A. A discal base plate 344 is installed at the cylindrical rib 340 and the propellers 338. The base plate 344 is spaced a predetermined distance from the bottom surface of the tank main body 334, and has a shorter radial length than the length of the propeller 338. The base plate 344 is installed to be nearly perpendicular to the propellers 338.

A space formed by the base plate 344 and the bottom surface of the tank main body 334 communicates with the suction portion 342. The space above the base plate communicates with a discharge portion 346 due to the space formed the inner wall of the tank main body 334 and the end portion of the base plate 344 having a shorter radial length than the length of the propeller 338. Therefore, the concentrated ink having passed the suction portion 342 flows in the direction of arrow B, and moves toward the upper portion of the tank main body 334. Then, the concentrated ink moved upward is again sucked into the suction portion 342, and is circulated and agitated within the tank main body 334. In such a structure, the concentrated ink moved by the expelling force of the propellers 338 can be agitated more effectively.

As shown in FIG. 12, a rotating shaft 352 is rotatably installed within a tank main body 354. A cap 356 is assembled to the upper portion of the tank main body 354. An installation hole 355 into which one end of the rotating shaft 352 is inserted is formed at the bottom of the tank main body 354. A through hole 357 through which the other end of the rotating shaft 352 can pass is formed at the center of the cap 356. A driven coupler 326 is installed at the other end of the rotating shaft 352 which passes through the through hole 357.

A plurality of impellers 358 are radially installed on the lower portion of the rotating shaft 352. The impellers 358 are installed to be inclined at a predetermined angle with respect to a lengthwise direction of the rotating shaft 352. The outer ends of impellers 358 are installed to be spaced about 1 mm from the inner wall of the tank main body 354. This space is intended for the outer ends of the impellers 358 not to interfere with the inner wall of the tank main body 354 when the impellers 358 rotate. The impellers 338 are connected to the rotating shaft 352 by a cylindrical rib 360 coaxially installed on the rotating shaft 332. Therefore, a suction portion 362 is formed between the inner circumferential surface of the cylindrical rib 360 and the rotating shaft 352 so that a concentrated ink fluctuated during the rotation of the rotating shaft 352 and the impellers 358 can be sucked along the direction of arrow A. A discal base plate 364 is installed at the impellers 358 and the cylindrical rib 360. The radius of the base plate 364 has a shorter length than the length of the impeller 338, and is installed to be spaced a predetermined distance from the bottom surface of the tank main body 354.

A discharge portion 366 can communicate with the suction portion 362 via the space. Therefore, the concentrated ink having passed the suction portion 362 flows in the direction of arrow B, and moves toward the upper portion of the tank main body 354. Then, the concentrated ink moved upward is again sucked into the suction portion 362, and is circulated and agitated within the tank main body 354.

As shown in FIG. 13, an ink agitator of a dual stage impeller as an example of a multi-stage impeller is installed on a rotating shaft 372 positioned in a lengthwise direction of a tank main body 374. The impeller 378 has at least two blades installed to be inclined at a predetermined angle with respect to the rotating shaft 372.

On the other hand, each ink storage tank comprises a liquid level sensor which measures the level of the concentrated ink stored therein. The liquid level sensor comprises a transparent window (not shown) installed at the wall of the tank main body 334 so as to have a predetermined height, a level blade (not shown) installed at the rotating shaft so as to rotate while contacting the transparent window, and a photosensor (not shown) installed at a main body of the printer on the same level as the level blade. The photosensor is a reflective type sensor which emits a light beam to the non-transmissive concentrated ink and senses the signal reflected from the concentrated ink. The level blade cleans the inner side of the transparent window smeared with the concentrated ink while rotating with the rotating shaft. Therefore, the photosensor which emits a light beam toward the transparent window senses the level of the ink at the moment when the level blade cleans the transparent window. That is, when the liquid level sensor is employed, the reliability of sensing the level of the ink can be assured even in a situation in which the concentrated ink can adhere to the inner wall of the tank main body.

Figure 14:
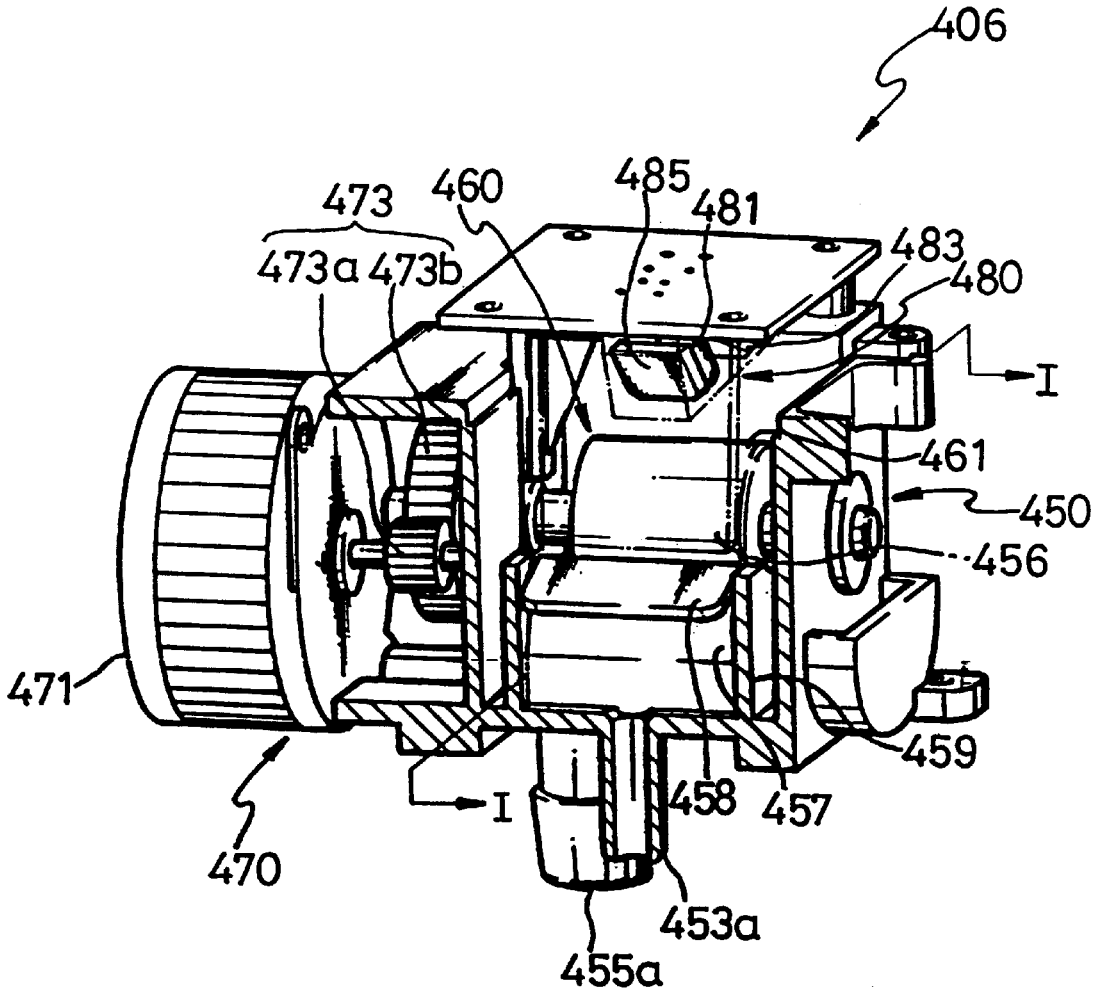
FIG. 14 is a partially cut away perspective view schematically illustrating the portion of a concentration measuring device of FIG. 1.
Figure 15:
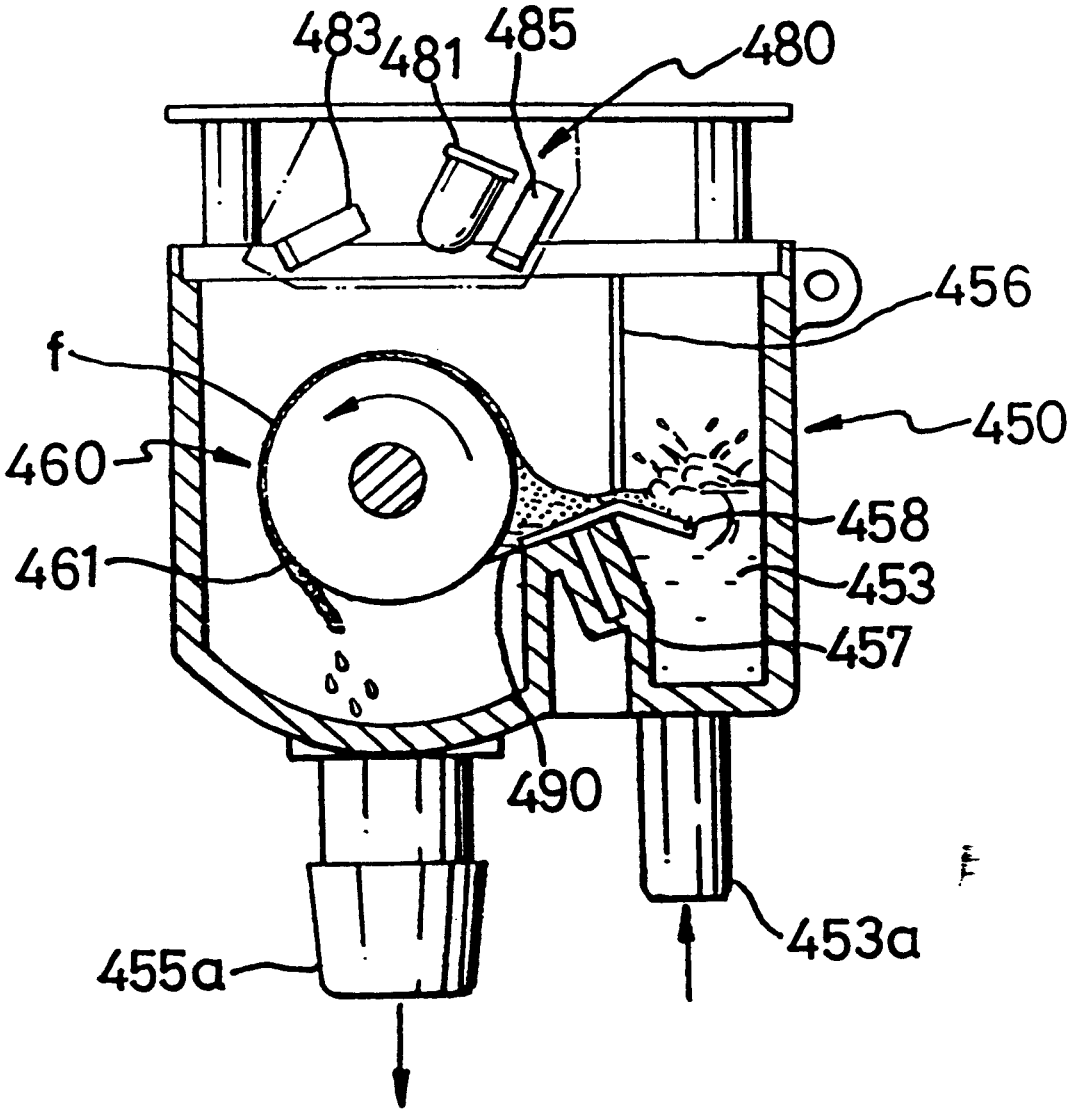
FIG. 15 is a sectional view taken along line 1—1 of FIG. 14.

As shown in FIGS. 1, 14 and 15, the concentration measuring device 406 includes a housing 450 which a corresponding developer can enter into or exit from, a roller 460 rotatably installed in the housing 450, a driving source 470 for rotating the roller 460, a developer supplying means for supplying the liquid developer toward the roller 460 so that a film of the developer can be formed on the roller 460 according to the rotation of the roller 460, and a sensor 480 emitting a light beam to the film and receiving the reflected light beam after passing through the film.

The housing 450 includes a developer supplying portion 453 filled with a developer at a predetermined level. The developer flows into the developer supplying portion 453 via a supply tube 453*a*. A valve which is opened during the operation of measuring the concentration of the developer and controls the amount of the developer supplied to the developer supplying portion is installed on the supply tube 453*a*. The developer entering into the housing 450 via the supply tube 453*a* is discharged to a corresponding circulation tank 400 via a discharge tube 455*a* provided at the bottom portion of the housing 450. Here, it is preferable that the discharge tube 455*a* has a sufficiently large diameter enough to cause the developer to not stagnate in the housing 450.

The developer supplying portion 453 and the roller 460 are spatially separated from each other by a partition wall 457 installed to have a predetermined height from the bottom surface of the housing 450. Therefore, when the amount of the developer supplied to the developer supplying portion 453 via the supply tube 453*a* is sufficient, the developer in the developer supplying portion 453 flows to the roller 460 over the partition wall 457.

At, at least, one side of the developer supplying portion 453, a wall portion 459 of a predetermined height are provided to be spaced from a side wall of the housing 450. When the developer is excessively supplied to the developer supplying portion 453 from the supply tube 453*a*, the wall portion 459 allows the excessive developer to overflow to the space between the wall portion 459 and the side wall of the housing 450. In addition, it is preferable that the wall portions 459 are formed to be extended to the sides of the roller 460. This is intended to overflow the developer supplied toward the roller 460 to the space between the wall portions 459 extendedly installed at the sides of the roller 460 and side walls of the housing 450, and to cause the roller 460 to contact the developer by a nearly constant predetermined height.

It is preferable that a buffer member 458 is installed at the developer supplying portion 453 to be projected from the partition wall 457 so as to lower the flow velocity of the developer supplied from the supply tube 453*a*. The buffer member 458 may be installed at the wall portion and/or a side wall of the housing 450.

A shielding member 456 is installed at the ceiling of the housing 450 to make a gap of a predetermined distance with the partition wall 457. Since the shielding member 456 prevents irregularities of flow of the developer from the developer supplying portion to the roller 460, which may occur due to unstableness of the developer entering the relatively wide developer supplying portion 453 from the relatively narrow supply tube 453*a*, and allows the surface of the developer at the roller 460 side to be maintained in a tranquil state, variations in the thickness of the developer film formed on the roller 460 are minimized, and precision of measuring the concentration of the developer can be realized.

In order to clean the rotating roller 460 after the developer film formed on the surface of the roller 460 is sensed by the sensor 480, a cleaning member such as a blade 490 is installed to contact the surface of the roller 460.

One end of the blade 490 is installed on the partition wall 457, and the other end contacts the surface of the roller 460. Two sides of the blade 490 contacts the wall portions 459. Therefore, the blade 490 serves as a guide member for guiding the developer flowing over the partition wall 457, and in addition forms a predetermined space portion with the wall portions 459. It is preferable that the blade 490 is installed to be inclined toward the lower portion of the roller 460. In this case, the developer supplied from the developer supplying portion 453 flows toward the roller 460 while being guided along the blade 490, and fills the space portion to a predetermined height. That is, the developer entering the space portion through the gap between the partition wall 457 and the shielding member 456 is restricted by the blade 490 contacting the surface of the roller 460, and scarcely leaks out below the roller 460. Here, the depth of one side of the roller 460 immersed in the developer filled in the space portion is decided by the relative installation position of the roller 460 with respect to the position of the gap. The blade 490 may be installed to be close to the roller 460 so as to serve as a guide member, and a cleaning member may be installed separately.

Since when the level of the developer flowing into the space portion rises, the excessive developer naturally overflows over the wall portions, the level of the developer in the space portion scarcely changes. When the roller 460 is rotated counterclockwise by operating the driving source 470, as shown in FIG. 15, a developer film of a predetermined thickness is formed on the surface of the roller 460. Here, when the level of the developer in the space portion is constant, the thickness of the developer film f can be maintained to be constant. The thickness of the developer film f is influenced by the rotational speed of the roller 460, the depth of the roller 460 immersed in the developer in the space portion, and the viscosity of the developer, in particular, the kinematic viscosity of the developer. For example, when the concentration of the developer is low, the viscosity of the developer is low and the thickness of the developer becomes thin.

When the concentration of the developer and the depth of the roller 460 immersed in the developer are constant, the thickness of the developer film f varies with the rotational speed of the roller 460. When the depth of the roller 460 immersed in the developer and the rotational speed of the roller 460 are constant, the thickness of the developer film varies with the concentration of the developer. When the other conditions are constant, the thickness of the developer film varies with types of developers, i.e., developers of yellow, magenta, cyan, and black colors. Therefore, standard data of rotational speeds of the roller 460, depths of the roller immersed in the developer in the space portion, thicknesses of developer films according to the concentrations of the developers and amounts of light reflected after passing through the developer films can be tabulated as a lookup table in which the data are classified by the colors of the developers. On the other hand, the range of concentrations of the developers which can keep the quality of prints proper is 2.5~3.5 wt %.

In this embodiment, when the range of the concentration of a developer is about 2.5~3.5 wt %, the rotational speed of the roller is 122 rpm, and a portion of the roller 460 corresponding to the arc surface having a central angle of about 10°~20° is immersed in the developer in the space portion, a developer film having a thickness of about 50~100 μm can be formed on the surface of the roller 460. In this case, the concentration of a black (K) developer having relatively low transmittance of light can be measured.

The driving source 470 includes a driving motor 471 such as a usual stepper motor capable of operating at a constant speed, a reduction gear assembly 473 for reducing the rotational speed of the driving motor 471 and transferring the rotational force of the reduced rotation speed to the roller 460. The driving source 470 may further comprises an encoder (not shown) for sensing a number of rotations of the driving motor 471, and a controller for controlling the rotational speed of the roller 460.

The reduction gear assembly 473 comprises a first gear 473*a* installed on the shaft of the driving motor 471, and a second gear 473*b* which is installed on the rotating shaft of the roller 460, and meshed with the first gear 473*a* and has more teeth than the first gear 473*a*.

The concentration measuring device 406 employs a so-called reflective type sensor 480 which detects an amount of light reflected after passing the developer film formed on the surface of the roller 460 with a light source and a photosensor which are installed outside the roller 460.

The sensor 480 includes a reflective member 461 installed at, at least a portion of the surface of the roller 460, a light source 481 emits a light beam to the developer film formed on the reflective member 461, a main photodetector 483 installed by the light source 481 for receiving the light reflected from the reflective member 461, and secondary photodetector 485.

It is preferable that the light source 481 is installed above the roller 460 so as to illuminate the developer film formed on the top portion of the roller 460. This is intended to illuminate a portion where change in thickness of the developer film within a predetermined area is minimized.

It is preferable that a light emitting diode or a semiconductor laser is used as the light source 481. In addition, the light source 481 emits light of an infrared range whose wavelength is above about 780 nm. The light of such an infrared range exhibits relatively high transmittance with respect to the developers of yellow, magenta, cyan, and black colors. The black developer exhibits low transmittance over infrared, visible light and ultraviolet ranges. However, desirable transmittance can be obtained by forming a thin developer film on the surface of roller 460. Therefore, the concentration of a developer can be measured regardless of a color of a developer by employing the light source 481 of the infrared wavelength range.

The light source can be realized by a light emitting diode emitting white light or the like, and a light source emitting light of suitable for colors of respective developers for measuring the concentration thereof can be employed.

It is preferable that the sensor 480 further comprises a concentration operation portion (not shown). The concentration operation portion compares a detected signal of the photodetector 483 with the standard data of the lookup table. In order to minimize influence of outside light on the concentration measuring device 406, it is preferable that the housing 450 is made of an opaque material, or the outside thereof is treated with a black color material.

Figure 16:
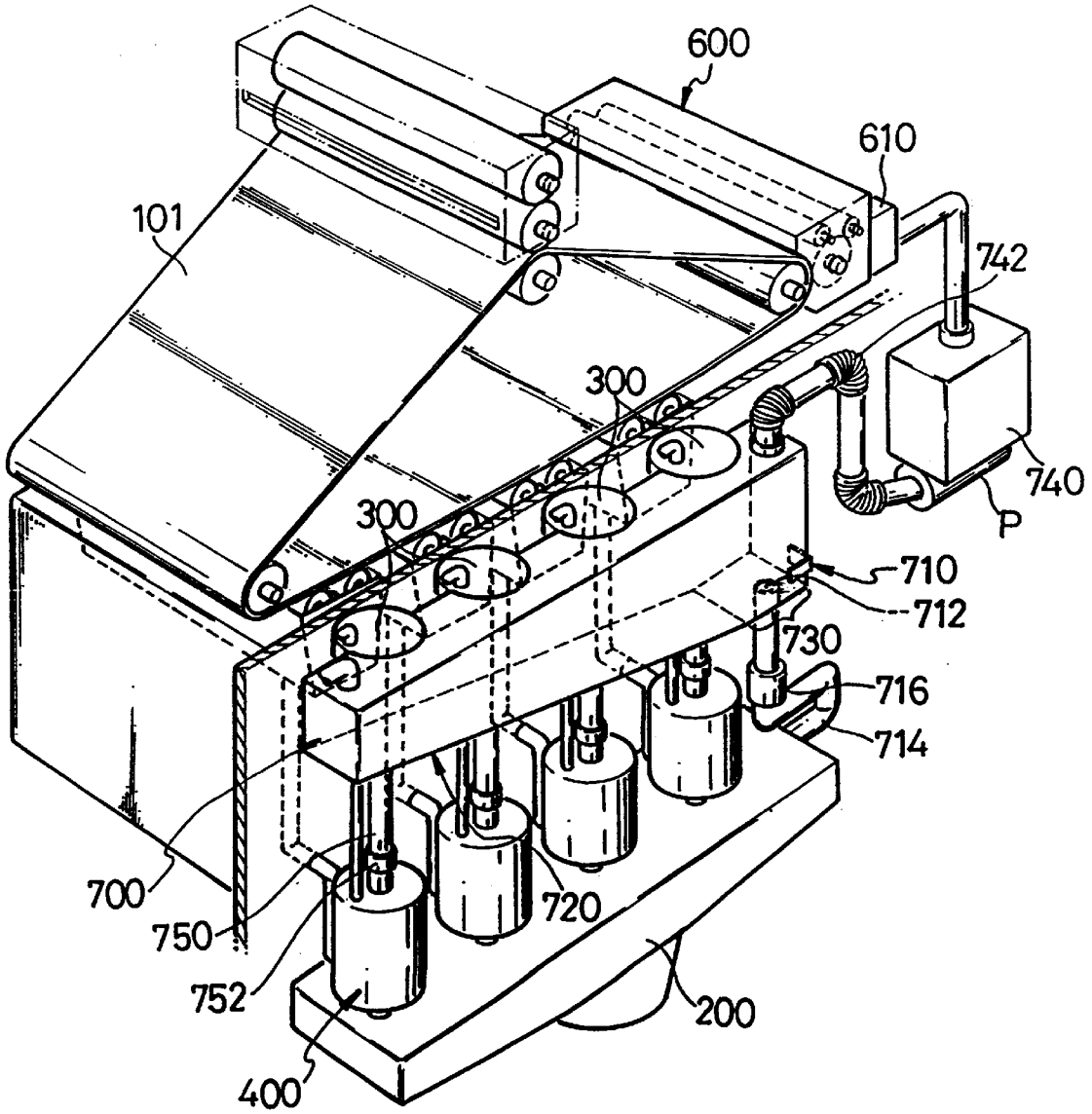
FIG. 16 is a perspective view schematically illustrating the portions of a carrier storage tank and a drying/condensing unit of FIG. 1.
Figure 17:
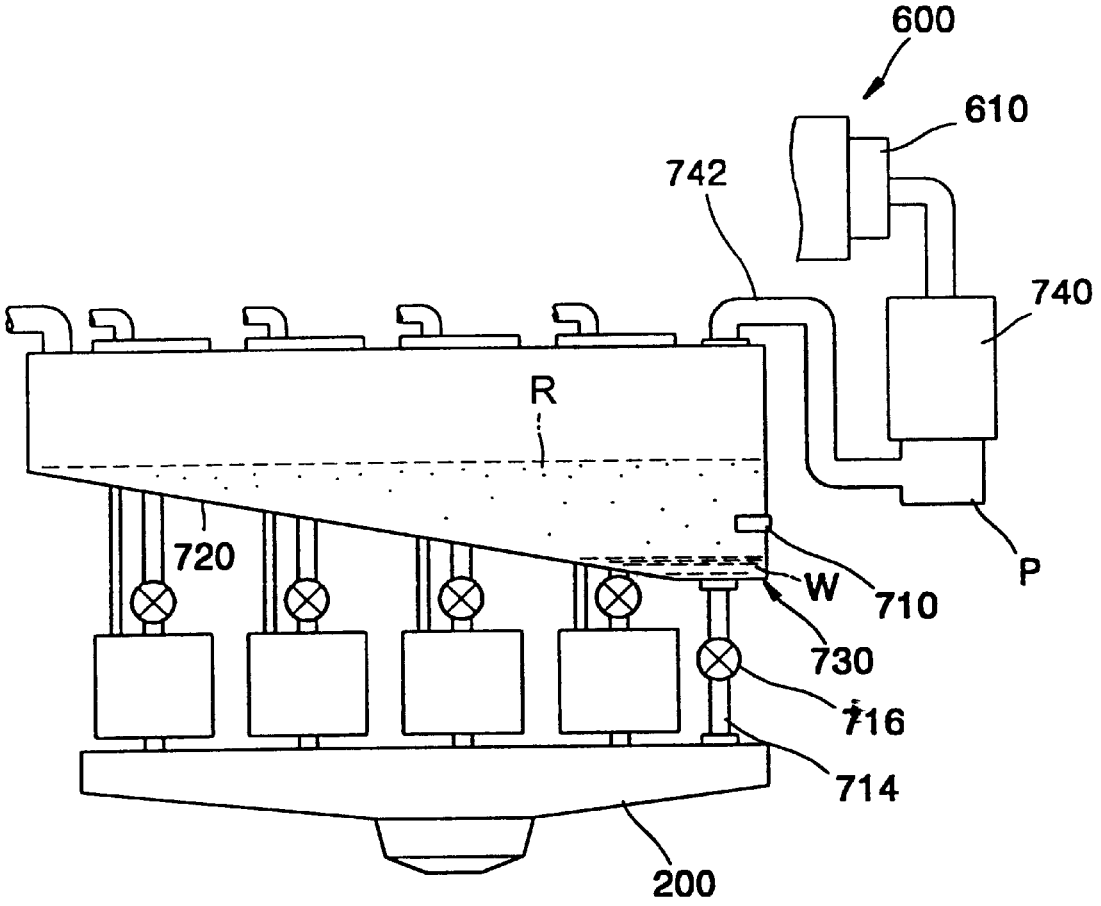
FIG. 17 is a structural diagram illustrating essential portions of FIG. 16.
Figure 18:
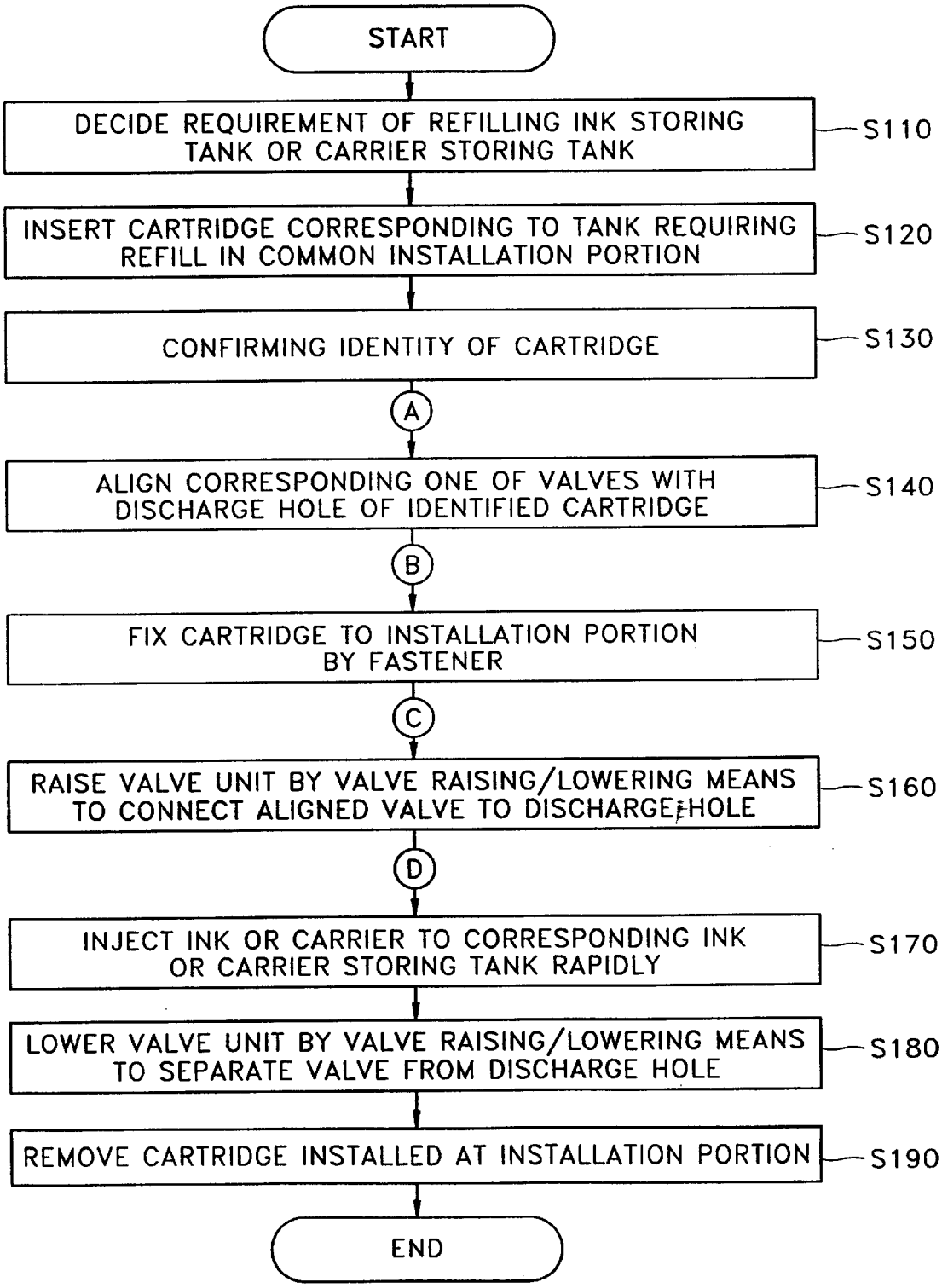
FIG. 18 is a flow chart illustrating an ink refilling method of a liquid electrophotographic color printer according to a preferred embodiment of the present invention.
Figure 19:
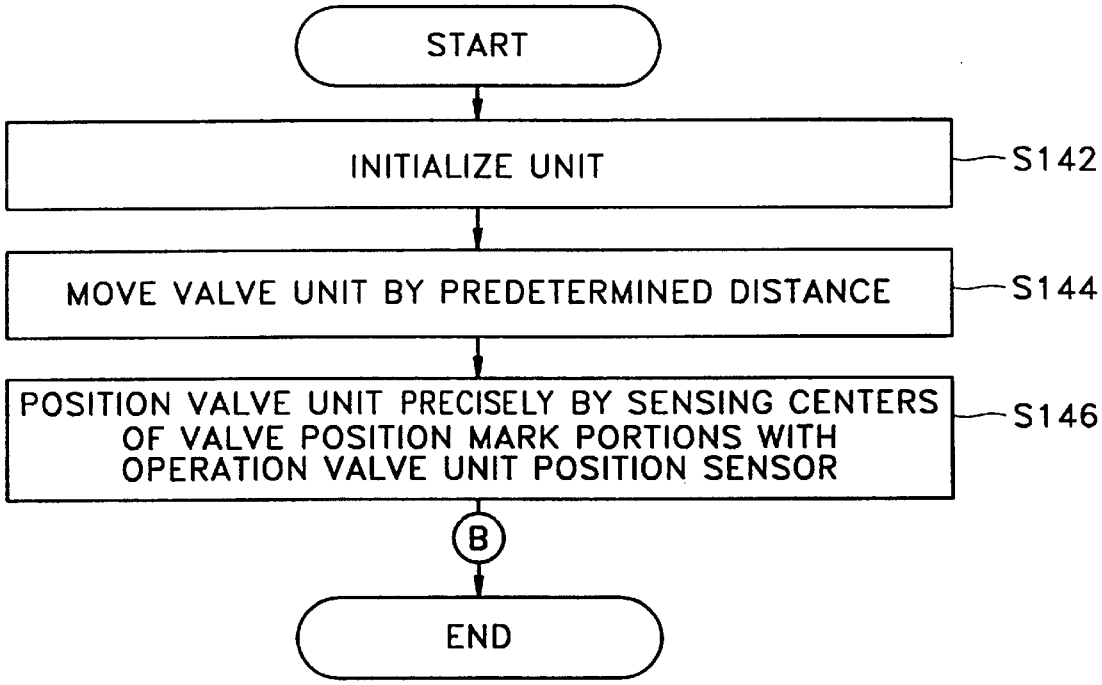
FIG. 19 is a flow chart illustrating in detail the step of aligning a valve with a discharge hole of a refill cartridge, of the steps shown in FIG. 18.

As shown in FIGS. 1, 16 and 17, though the carrier storage tank 700 is basically supplied with carrier from a refill cartridge 140, the carrier storage tank 700 is also supplied with the carrier recovered at the drying/condensing unit 600. The drying/condensing unit 600 condenses the carrier remaining on the photosensitive belt 101 after development and moisture of the air inevitably flowing therein from the outside, and supplies the carrier to the carrier storage tank 700. A water sensing sensor 710 is installed at the lower portion of the carrier storage tank 700 so as to sense water produced during a condensing process of the condenser 610. A discharge hole 712 is disposed in the vicinity of the water sensing sensor 710. The carrier storage tank 700 is connected to the waste tank 200 by a water discharge pipe 714. A valve 716 which is selectively opened or closed according to a state sensed by the water sensing sensor 710 is installed on the water discharge pipe 714.

An inclined surface 720 is formed at the bottom of the carrier storage tank 700. A horizontal surface 730 is formed at one end of the inclined surface 720. The water sensing sensor 710 is disposed above the horizontal surface 730. Reference number 740 denotes a purge tank to which the vaporized carrier by the drying/condensing unit 600 and moisture of the air inevitably flowing therein from the outside is recovered as a carrier and water after being condensed.

A conductivity sensing sensor which measures the conductivity of a predetermined liquid and senses whether the liquid exists or not is used as the water sensing sensor 710. The conductivity sensing sensor discriminately senses the carrier and water by utilizing that the conductivity values of the carrier and water are different from each other. In general, water has a higher conductivity than a carrier. An inflow pipe 742 to which a carrier and water flow in from the purge tank 740 is installed at an upper portion of the carrier storage tank 700. The inflow pipe 742 is installed to correspond to the water discharge pipe 714.

As shown in FIG. 17, the carrier R and water W vaporized and condensed by the drying/condensing unit 600 are recovered to and temporarily stored in the purge tank 740, and, thereafter, are transferred to the carrier storage tank 700 by the operation of a motor P. At this time, the water W and oily carrier R are stratified due to a difference in their specific gravity values, that is, the water W gathers on the horizontal surface 730 of the carrier storage tank 700, and the carrier R gathers on the water W and the inclined surface 720.

When the level of water W reach the position of the water sensing sensor (the conductivity sensing sensor) 710 as the quantity of the water W and carrier R repeatedly stored in the carrier storage tank 700 in a stratified state is gradually increased, the water sensing sensor 710 senses the level of the water W, and send a control signal to a not shown system controller. Therefore, the system controller causes the valve 716 installed on the water discharge pipe 714 to open so that the water W gathering on the horizontal surface 730 of the carrier storage tank 700 can be transferred to the waste tank 200.

Though the quantity of the condensed water W in an instance may vary with surrounding conditions of a printer, the water W is always stored so as to gather below the level of the water sensing sensor 710 in the carrier storage tank 700. That is, the quantity of the water W stored to the level of the water sensing sensor 710 from the bottom surface, in particular, the horizontal surface 730 of the carrier storage tank 700 is always constant. Therefore, after a time required for discharging the stored water W of a constant quantity is set in advance and the set time is stored in the system controller, and when the set time is passed during the operation of discharge of the stored water W, the system controller causes the valve 716 installed on the water discharge pipe 714, and the discharge of the water can be completed without discharging the carrier R.

On the other hand, while the stored water W is discharged via the water discharge pipe 714 by the action of the water sensing sensor 710, the carrier R can be simultaneously transferred to a corresponding circulation tank 400. This operation can be performed by controlling a corresponding valve 752 so as to be opened simultaneously with the valve 716 installed on the water discharge pipe 714. Here, the valve 752 is installed on a connecting pipe 750 connecting the carrier storage tank 700 and the circulation tank 400.

The operation of the ink delivery system having the above structure according to this embodiment will be described as follows.

First, the remaining quantities of the concentrated inks or carrier stored in the ink storage tanks 300 or carrier storage tank 700 is checked by level sensors 302 and 702 installed at the tanks 300 and 700, respectively. If the level information is "low level" or "empty", the system controller generates a message of "refill cartridge required flag" so that a corresponding tank can be refilled with a concentrated ink or carrier. Here, the tank requiring to be refilled may be an ink storage tank or carrier storage tank. If an ink storage tank must be refilled, the color of the ink, i.e., yellow, magenta, cyan, or black is determined.

Subsequently, a user installs a corresponding refill cartridge 140 at the installation portion 112 via the cartridge guide 119. Then, the system controller causes the three sensors installed at the sensor block 118 to sense the lustrous lines 145 marked in the lustrous line mark portions 144 formed on the lusterless surface of the refill cartridge 140 exists or not, and the positions of the lustrous lines, and decides whether the refill cartridge 140 installed at the installation portion corresponds to the tank requiring to be refilled according to the sensed results. If the cartridge 140 does not correspond to the tank requiring to be refilled, the system controller generates such information, and when the cartridge 140 corresponds to the tank, the next sequence will be followed.

Next, the cam driving motor 176 is rotated clockwise in FIG. 6 so as to fix the refill cartridge 140 to the main frame 110. Then, the first gear 178 install on the rotating shaft of the cam driving motor 176 is rotated in the direction indicated by arrow L, the rotational force thereof is transferred to the first power transfer system 180 and the second gear 182 is rotated in the direction indicated by arrow N. However, the cam shaft 170 is not rotated due to the first one-way bearing 184 installed between the second gear 182 and the cam shaft 170. Therefore, the valve unit 130 is not raised. On the other hand, the rotational force of the cam driving motor 176 is transferred via the second power transfer system 190 connected with the first gear 178, and rotates the third gear 192 in the direction indicated by arrow Q, the second one-way bearing 194 installed between the third gear 192 and the worm 166 rotates the worm 166 in the same direction as the third gear 192. The pair of worm wheels 164 meshed with the worm portions 167 of the worm 166 are rotated in opposite directions. Then, the locker cams 160 are rotated by the rotation of the worm wheels 164, and the cam poles 162 inserted in the cam grooves 161 of the locker cams 160 are moved in the elongates locker holes 111. Therefore the lockers 156 are moved toward the refill cartridge 140 with respect to the main frame 110, and the lockers 156 are engaged with the engagement portion 152. At the point in time when the lockers 156 are engaged with the engagement portion 152 of the cap 154, the locker cam sensors 169 are operated to confirm the engagement of the lockers 156 with the engagement portion 152. Thereafter, the system controller causes the cam driving motor 176 to stop, and therefore the refill cartridge is fixed to the main frame 110.

Subsequently, the slider 134 is moved a predetermined distance from the initial position so as to align the valve communicating with the tank requiring to be refilled with the discharge hole 142. To this end, when the slider driving motor 128 is rotated by a predetermined number of degrees when the slider 134 is positioned at the initial position, the slider pinion 126 is rotated, and the slider 134 is moved while being supported by the guide rods 124. Therefore, the valve communicating with the tank requiring to be refilled is aligned with the discharge hole 142. The predetermined number of degrees is set to be different according to the plurality of valves 132, the slider position sensor 136 senses the exact position of the valve 132 owing to the mark portions 135.

Next, the valve raising/lowering mechanism is operated so as to connect the aligned valve 132 with the discharge hole 142 and to supply the content of the refill cartridge 140 to the tank requiring to be refilled. To this end, in a state in which the auxiliary frame 120 is lowered to the lowest position with respect to the main frame 110, the cam driving motor 176 is rotated in a counterclockwise direction in FIG. 6 ( the direction opposite to the direction of arrow L). Then, whereas the rotational force of the cam driving motor 176 transferred via the second power transfer system 190 is blocked by the second one-way bearing 194 installed on the worm 166, the rotational force transferred via the first gear 178 and the first power transfer system 180 rotates the second gear 182 in the opposite direction of arrow N. The cam shaft 170 is rotated in the same direction as the second gear 182 by the first one-way bearing 184. Then, the cam members 172 are rotated in the opposite direction of arrow N to raise the slider supports 121 of the auxiliary frame 120, and the cam members 172 raises the auxiliary frame 120 at the highest position, and the cam driving motor 176 stops rotating in this state. Therefore, the discharge hole 142 of the refill cartridge 140 and the valve 132 are connected to each other, and the content of the refill cartridge 140 is discharged through the valve 132 by the pressure of compressed air and rapidly supplied to the tank requiring to be refilled.

Next, after the tank is refilled, the cam driving motor 176 is further rotated until the auxiliary frame reaches the lowest position. During this process, the valve 132 is lowered to be disconnected from the discharge hole 142. On the other hand, the slider 134 moved by the predetermined distance must be returned to the original position, and to this end, the slider driving motor 128 must be rotated by the same number of degrees as in the aligning operation but in the opposite direction.

Subsequently, when the cam driving motor 176 is further rotated so as to unfix the refill cartridge 140 fixed to the installation portion 112, the rotational force is not transferred to the cam shaft 170, but transferred via the second power transfer system 190 and rotates the worm 166. Therefore, the pair of the lockers 156 are moved away from the refill cartridge 140, and when the lockers 156 are moved to the farthest positions from the refill cartridge 140, the locker sensors 169 are operated to stop the cam driving motor 176. Thereafter, the refill cartridge 140 is disassembled from the installation portion 132 and the cartridge guide 134.

On the other hand, when waste developer stored in the waste tank 200 increases and needs to be recovered to the outside, an empty refill cartridge is again installed at the installation portion 112, or the operation of recovering the developer may be performed in a state in which an empty refill cartridge 140 is fixed at the installation portion 112 after an ink refilling process. In this embodiment, the latter will be described as an example.

First, the auxiliary frame 120 raised with respect to the main frame 110 is lowered to cause the valve unit 130 to return to the original position. Thereafter, the slider driving motor 128 is rotated a predetermined number of degrees so that the waste developer valve 132*c* can be aligned with the discharge hole 142. Next, the valve unit 130 is raised as in the developer refill operation to cause the waste developer valve 132*c* to be connected to the discharge hole 142. In this case, the waste developer stored in the waste tank 200 can be supplied to the empty refill cartridge by using the waste pump 240 installed on the waste developer passage 244.

On the other hand, in order to agitate the content within the waste tank 200, the steps of operating the waste tank 200 will be described as follows.

First, when the waste developer and/or overflowed developer within the circulation tanks 400, and the water of the condenser 610 are supplied to the waste tank 200, via the waste developer inflow portions 216 and the recovery pipe 224, respectively, the mixed waste gathers at the cylindrical agitation portion 230 due to the inclined surface. Since the mixed waste precipitates or adheres to the waste tank 200 when the mixed waste is left as it is for a long time, the mixed waste flows into the main body 220 of the waste tank 200 along the side wall of the cylindrical agitation portion 230 via the jet orifice 234 when the waste pump 240 installed between the waste developer discharge port 232 and the jet orifice 234 is operated, and the two-way valve 250 is operated to open the first passage 242. Therefore, the mixed waste stored in the main body 220 can be agitated while circulated along the side wall of the cylindrical agitation portion 230 by the jetted pressure of the waste developer jetted from the jet orifice 234.

The operation of the concentration measuring device 406 for measuring the developer stored in the circulation tank 400 will be described as follows.

First, the developer stored in the circulation tank 400 is supplied to the developer supplying portion 453 via the supply tube 453*a* so as to measure the concentration of the developer supplied to the corresponding developing unit 500. Then, a portion of the developer of the developer supplying portion 453 flows to the roller 460 through the gap between the partition wall 457 and the shielding member 456, and the remaining developer flows over the wall portions 459, falls to the bottom of the housing 450, and is discharged through the discharge tube 455*a*. The developer flowing through the gap is restricted by the blade 490 contacting the roller 460 and fills the space portion to a predetermined height. Therefore, a side of the roller 460 is immersed in the developer to the predetermined height. Here, even when the amount of the developer flowing into the space portion through the gap increases, the height of the developer in the space portion is kept constant since the excessive developer flows over the wall portions 459 installed at the sides of the roller 460, falls to the bottom of the housing 450, and is discharged through the discharge tube 455*a*. In this state, when the roller 460 is rotated by the driving source at a predetermined rotational speed, a developer film of a predetermined thickness is formed on the surface of the roller 460. In this state, when the sensor 480 is operated, the light beam emitted from the light source 481 passes through the developer film, and is reflected from the reflective member 461. Then, the reflected light beam again passes through the developer film, and is detected by the main photodetector 483. In this process, the concentration operation portion compares the detected signal of the main photodetector 483 with the standard data of the lookup table, and outputs the signal of the developer concentration.

On the other hand, when the roller 460 continues to rotate, most of the developer film on the surface of the roller 460 falls from the surface of the roller 460 to the bottom of the housing 450 due to the gravity. In addition, the developer remaining on the surface of the roller 460 is cleaned by the blade 490. In addition, the developer at the bottom of the housing is discharged through the discharge tube 455*a*.

FIGS. 18 through 22 are flow charts illustrating ink refilling methods of an liquid electrophotographic color printer according to preferred embodiments of the present invention. These refill methods are employed in the ink delivery system described with reference to FIGS. 1 through 17.

As shown in FIGS. 1 through 22, first, when any one of concentrated inks or a carrier stored in the respective ink storage tanks 300 or a carrier storage tank 700 is completely consumed in a print mode, it is determined whether refilling any one of the concentrated inks and the carrier exists is required (step S110). Such determination is performed by level sensors 302 and 702 installed at the storage tanks 300 and 700, and a system controlling portion (not shown) generating a message "cartridge requiring flag" in the from of "low" or "empty" concerning the information of a liquid level of any one of the storage tanks 300 and 700 according to the information of a liquid level of the level sensors 302 and 702.

Next, in step S120, a user inserts a refill cartridge 140 corresponding to the storage tank requiring refilling into a common installation portion 112 via a cartridge guide 119.

Subsequently, in step S130, the identity of the refill cartridge 140 is confirmed. That is, whether the inserted refill cartridge 140 is an ink refill cartridge or a carrier refill cartridge is determined, and if the refill cartridge 140 is an ink refill cartridge, whether the color of the ink is yellow, magenta, cyan, or black is determined. To this end, the system controlling portion operates the three sensors 116 installed at a sensor block 118. The sensors 116 sense whether the lustrous lines 145 marked on the lustrous line mark portions 144 formed on the lusterless surface of the refill cartridge 140 exist, or the positions thereof, and according to the sensed information, the system controlling portion determines whether the refill cartridge 140 corresponds to the storage tank requiring a refill. The detailed determining method is shown in Table 1. When a cartridge which does not correspond to the storage tank requiring a refill or is different from the specifications of the refill cartridge used in the present invention is installed, the system controlling portion transfers a message such as "Insert another cartridge" or "Not a defined cartridge" to an operation panel of the printer. When a corresponding refill cartridge is inserted, the sequence proceeds as follows.

That is, in step S140, any one of a plurality of valves 132 installed at a valve unit 130 is aligned with a discharge hole 142 of the identified refill cartridge 140. This step will be described in detail with reference to FIG. 19.

First, the valve unit 130 is initialized in step S142. Here, a slider 134 is used in moving the valve unit 130. The initialization of the valve unit 130 is intended to prevent misalignment of the refill cartridge 140 with a corresponding valve which occurs when a motor, for example, a step motor for driving the slider 134 is rotated a predetermined number of degrees in the next step with the slider 134 not disposed at the initial position. Such initialization is decided by a first mark portion of slider mark portions 135.

Subsequently, in step S144, the valve unit 130 is moved a predetermined distance. That is, the slider 134 is linearly moved from the initial position so that the valve communicating with the storage tank requiring a refill can be aligned with the vertical center line of the refill cartridge 140. Here, the predetermined number of degrees is set to be different from each other according to the positions of the plurality of valves 132, and the slider position sensor 136 senses the exact positions of the valves 132 by means of the mark portions 135.

Subsequently, in step S146, it is preferable that the valve unit 130 is precisely positioned by sensing the exact centers of the slider mark portions 135 with the valve unit position sensor 136. Such positioning allows the corresponding valve to be precisely aligned with the discharge hole.

Next, in step S150, the refill cartridge 140 is installed in the installation portion 112 and fixed by a fastener 150. Here, the fastener 150 may be composed of a pair of lockers being movable back and forth and an engagement portion 152.

Figure 20:
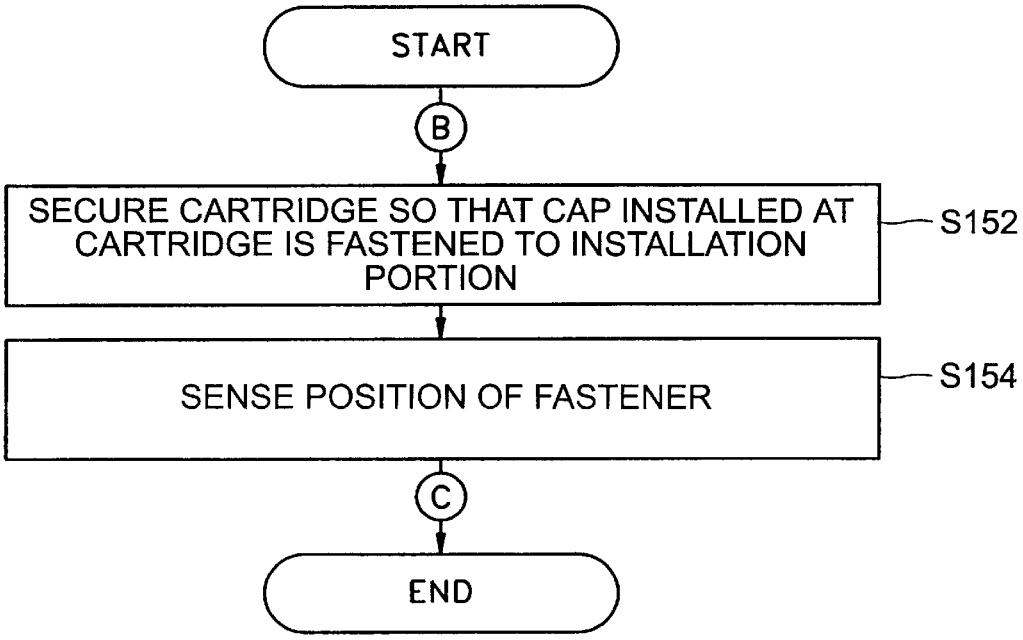
FIG. 20 is a flow chart illustrating in detail the steps of securing a cartridge to an installation portion, of the steps shown in FIG. 18.
Figure 21:
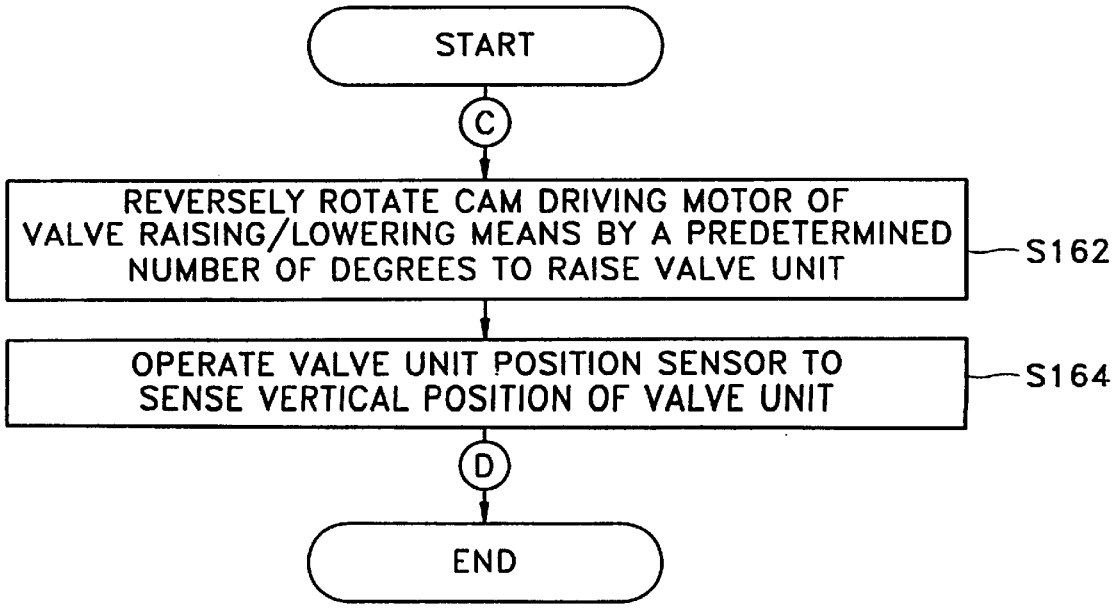
FIG. 21 is a flow chart illustrating in detail the step of raising a valve unit with a valve raising mechanism so as to connect an aligned valve to a discharge hole, of the steps shown in FIG. 18.

As shown in FIG. 20, in the case of the locker type fastener 150, in step S152, a cam driving motor 176 of the valve unit 130 is rotated clockwise a predetermined number of degrees (please refer to the previously described ink delivery system about the detailed operation thereof).

Next, in step S154, the position of the lockers 156 which are engaged with the engagement portion is sensed. This sensing is intended to maximize the fixing force of the lockers 156 against the refill cartridge 140 by stopping the lockers when the lockers 156 being inserted into a cam groove 161 is moved toward the refill cartridge 140 to a maximum. That is, after the engagement of the lockers 156 with the engagement portion 152 is confirmed by operating a locker cam sensor 169 at the moment when the lockers 156 are going to complete the engagement with the engagement portion 152 of the cap 154, the refill cartridge 140 can be fixed to a main frame 110 by stopping the cam driving motor 176.

Here, the step S140 and the step S150 are not necessarily performed in a time series, i.e., sequentially. That is, after the step of installing a refill cartridge and fixing the refill cartridge by the fastener, a corresponding valve may be aligned with the discharge hole of the refill cartridge.

In step S160, the valve unit 130 is raised by a valve raising/lowering mechanism so as to connect the aligned valve to the discharge hole 142. This operation will be described in detail with reference to FIG. 21.

First, in step S162, the cam driving motor 176 of the valve raising/lowering mechanism is rotated counterclockwise a predetermined number of degrees so as to raise the valve unit 130 (please refer to the previously described ink delivery system about the detailed operation thereof).

Subsequently, in step S164, the valve unit position sensor is operated so as to sense the vertical position of the valve unit 130. This is intended to prevent the valve connected with the discharge hole 142 from being separated from the discharge hole 142 due to further rotation of the cam driving motor 176 by stopping the valve unit at the highest position.

Next, in step S170, the ink or carrier is rapidly injected into the corresponding ink storage tank or the carrier storage tank. Such rapid injection can be performed by compressed gas in the refill cartridge 140. The refill cartridge 140 has no hole other than the discharge hole 142. However, since the compressed gas can cause the ink or carrier in the refill cartridge 140 to be rapidly supplied to the corresponding tank via the discharge hole 142, the problem of long injection time can be solved.

Subsequently, in step S180, the valve unit 130 is lowered by the valve raising/lowering mechanism so that the valve can be separated from the discharge hole 142. This operation can be performed by simply repeating the step S160. Here, it should be noted that when the valve unit 130 reaches the lowest position, the cam driving motor 176 must be stopped.

Finally, in step S190, the refill cartridge installed at the installation portion 112 is separated from the installation portion 112. This can be performed by the withdrawal of the lockers or the reverse rotation of the refill cartridge. Returning the slider 134 moved by the predetermined distance back to the initial position allows the following operation to be smoothly performed.

Figure 22:
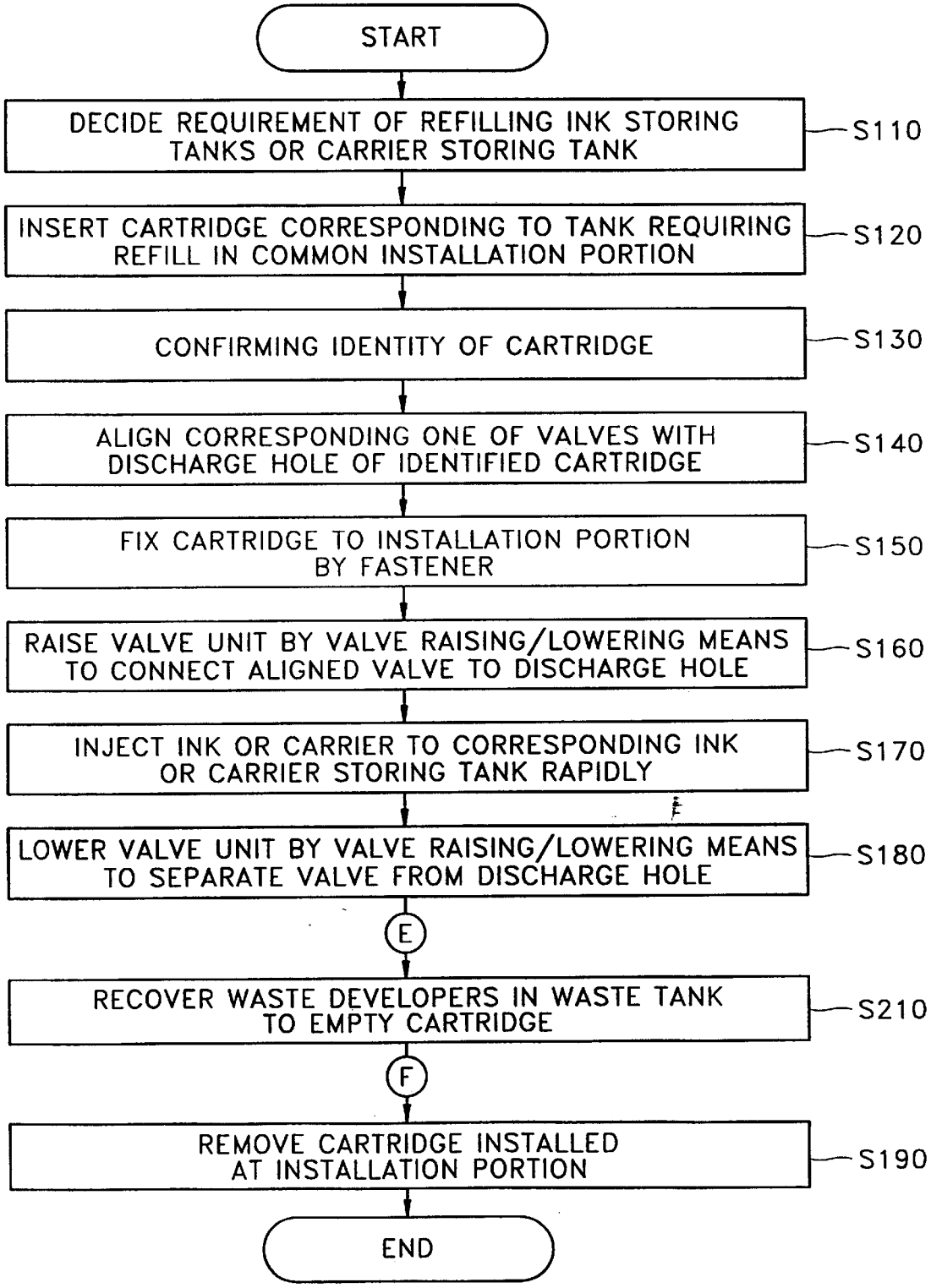
FIG. 22 is a flow chart illustrating an ink refilling method of a liquid electrophotographic color printer according to another embodiment of the present invention.

FIG. 22 is a flow chart illustrating a liquid developer refilling method of a liquid electrophotographic printer according to another embodiment of the present invention. Since the same reference numerals as those shown in FIG. 18 denotes the same step as the previous embodiment, detailed description thereof is omitted.

In this embodiment, after the refilling operation with a refill cartridge is completed, the empty refill cartridge is not separated from the installation portion, and waste developer within the waste tank is supplied to the empty refill cartridge fixed to the installation portion, and therefore less effort can be exerted by installing a separate empty refill cartridge for recovering the waste developers. It is preferable that such waste developer recovering operation is performed after a liquid developer is refilled when the waste tank is full.

Figure 23:
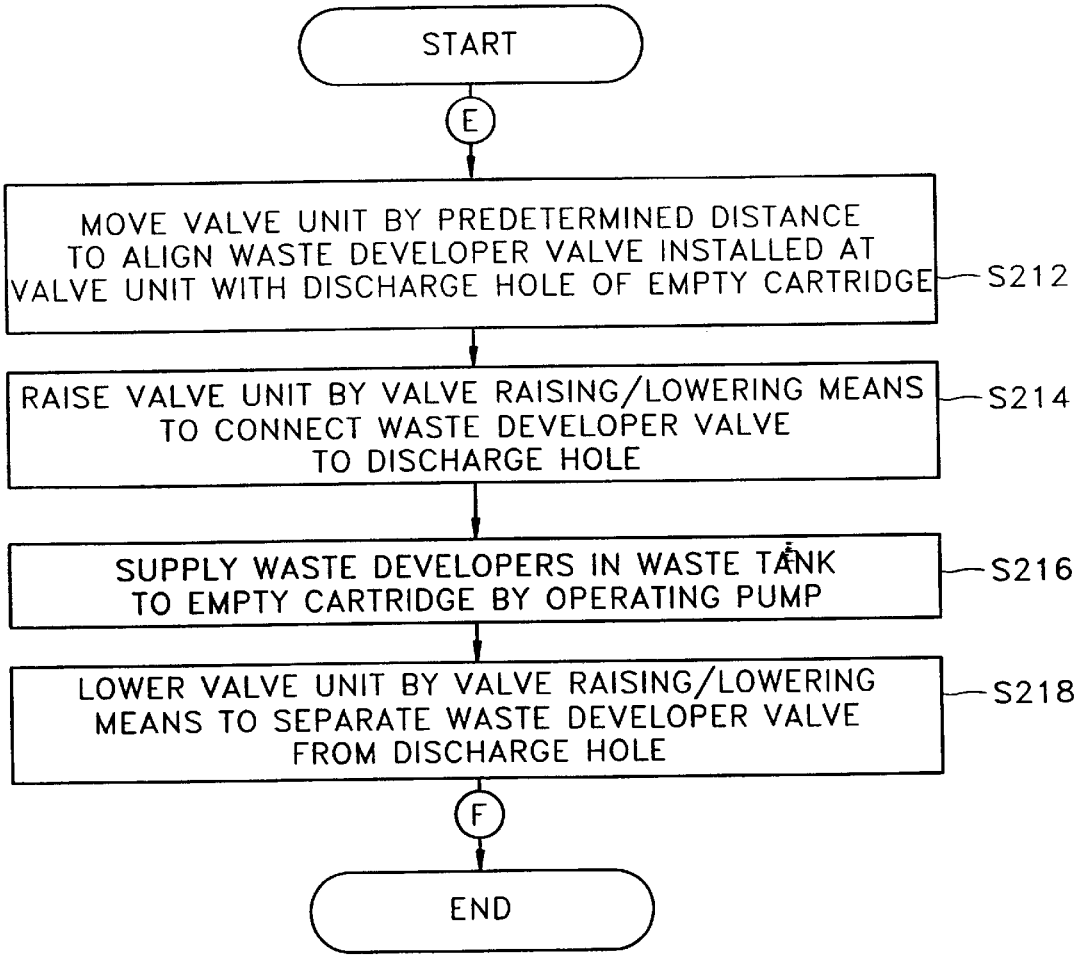
FIG. 23 is a flow chart illustrating in detail the step of recovering waste developer within a waste tank to an empty refill cartridge, of the steps shown in FIG. 22.

Referring to FIGS. 1 through 17 and FIG. 22, step S210 is performed with the valve unit lowered after a liquid developer is refilled. That is, waste developer within the waste tank 200 is recovered to an empty refill cartridge 140. This is preferable when the waste tank 200 is full of waste developer and there is a need to recover the waste developer to the outside as described above. This operation will be described in detail with reference to FIG. 23.

First, in step S212, the valve unit 130 is moved a predetermined distance so that a waste developer valve 132*c* installed at the valve unit 130 can be aligned with the discharge hole 142 of the empty refill cartridge 140. The principle of this operation is the same as that described in step S144, and different only in the moving distance. Here, the valve unit 130 may be moved by a predetermined distance as to the position of the waste developer valve 132*c* after the valve unit 130 is initialized. However, when the positions of the valves are determined in advance, the same effect can be acquired by moving the valve unit 130 a predetermined distance determined by the relative positions between the valves even though the valve unit 130 is not initialized.

Next, in step S214, the valve unit 130 is raised to the highest position by the valve raising/lowering mechanism so that the waste developer valve 132*c* can be connected to the discharge hole 142. This operation is the same as in the step S160.

Subsequently, in step S216, the waste developer within the waste tank 200 is supplied to the empty refill cartridge 140 by operating a waste pump 240 communicating with a waste developer passage 244. In this case, the discharge hole 142 of the refill cartridge 140 serves as a waste developer inflow hole.

After the waste developer is sufficiently discharged, finally in step S218, the valve unit 130 is lowered by the valve raising/lowering unit so that the waste developer valve 132*c* can be separated from the discharge hole 142.

As described above, the liquid developer refilling system of a liquid electrophotographic printer according to the present invention exhibits the following effects.

First, after the plurality of valves are installed at the slider so that a corresponding valve can be aligned with the refill cartridge installed in the common installation portion, and the corresponding valve is aligned with the discharge hole by the horizontal movement of the slider, the valve can be selectively aligned with the discharge hole by raising the valve unit using the cam.

Second, since the refill cartridge of the same specifications is used at the common installation portion for refilling the concentrated inks and the carrier, the efficiency of the system can be heightened.

Third, when a waste valve is added to the plurality of valves and an empty refill cartridge is used for recovering waste developer, the liquid developer refilling system can be used as a waste developer recovering system.

Fourth, since the plurality of valves can be arranged to be compact in the case of the slider type valve aligning system, the present invention can contribute to making the apparatus compact.

Fifth, since lustrous line portions are provided at a predetermined position of the refill cartridge surface treated to be lusterless, and a plurality of sensors are installed for confirming the identity of the cartridge according to whether the lustrous lines positioned on the lustrous line portions exist or not and the positions thereof, the cartridge can be easily recognized.

Sixth, since one of the plurality of sensors installed on the sensor block is used as a spare sensor and can be utilized with the other sensors when any one malfunctions, the efficiency of the system can be heightened.

Seventh, since the fastener for fixing a refill cartridge to the main frame is configured to fasten the refill cartridge in an automatically-operated-locker manner, the refill cartridge can be stably installed at the main frame.

Eighth, since the motor for using in the cam driving means can be used as a motor for driving the locker moving portions, the cost of the system can be decreased.

Ninth, the cylindrical agitation portion is installed at the lower portion of the waste tank, and waste developer is circulated and agitated by the pump, and therefore such circulation and agitation prevents the waste developer from adhering or precipitating to the main body of the waste tank.

Tenth, since the ink agitators installed in the plurality of ink storage tanks are driven by a single driving source and belt/pulley, the number of components for driving the ink agitators is decreased.

Eleventh, since, in the structure of the ink agitator, the base plate and cylindrical rib are installed between the propellers or impellers, and a concentrated ink is circulated and fluctuated by the propeller or impeller, the efficiency of agitation can be enhanced.

Twelfth, since a developer film of a predetermined thickness is formed on the surface of the rotating roller installed at a side of a space filled with a developer to a predetermined level, and the concentration of a developer is measured by measuring the amount of light beam passing through the developer film and reflected from the surface of the roller, the concentration measuring device can be configured to not interfere the main flow of the developer, and even when the transmittance of the developer is low, the concentration of the developer can be precisely measured.

Thirteenth, the ink storage tanks and carrier storage tank which include functional components are disposed in the main body of a printer, and when any one tank is required to be refilled with the concentration inks or carrier, a refill cartridge is selectively installed at the refill cartridge installation portion for refilling the tank. Therefore, a user can easily supply a concentration ink or carrier to a corresponding tank. In addition, since a refill cartridge does not include any functional component, the cost of a refill cartridge is low.

Although particular embodiments of the invention have been described with reference to the accompanying drawings for the purposes of illustration, it should be understood that various modifications and equivalents may be made by those skilled in the art without departing from the spirit and scope of the invention. Accordingly, it must be understood that the invention is limited only by the attached claims.

What is claimed is:

1. An ink delivery system of a liquid electrophotographic color printer for supplying liquid developers of predetermined concentration each of which is a mixture of a toner and a liquid carrier to a plurality of developing units, respectively, and for recovering the carrier using a drying/condensing unit which absorbs and evaporates the carrier remaining on a photosensitive medium after development, comprising:

a plurality of circulation tanks which store respective developers to be supplied to the developing units, and comprise respective concentration measuring devices which measure the concentration of the developers;

a waste tank receiving waste developer produced in the plurality of circulation tanks and provided with a waste developer agitating device which agitate the waste developer;

a plurality of ink storage tanks which store concentrated inks of predetermined colors to be supplied to the circulation tanks, respectively, and in which respective ink agitators driven by a single driving source are installed;

a carrier storage tank which stores a carrier to be supplied to the circulation tanks, and is provided with an inclined surface at the bottom so that water and a liquid carrier condensed by the drying/condensing unit can be stored in a stratified state;

a refill cartridge which stores a concentrated ink or carrier with compressed air and is removably installed at a common installation portion provided at a main body of the printer; and a developer refilling/waste recovering mechanism which refills a concentrated ink or carrier of the refill cartridge into a corresponding ink storage tank or carrier storage tank and which recovers the waste developer stored in the waste tank to an empty refill cartridge.

2. The ink delivery system of a liquid electrophotographic color printer as claimed in claim 1, wherein the developer refilling/waste recovering mechanism comprises:

a sending unit for recognizing an identity of the refill cartridge installed at the installation portion;

a valve unit at which a plurality of valves are installed to be selectively aligned with the refill cartridge and which is installed to be movable with respect to the main body of the printer; and a valve raising/lowering mechanism which raises or lowers the valve unit with respect to the main body of the printer so that the valve aligned with the refill cartridge can be connected to or separated from the refill cartridge.

3. The ink delivery system of a liquid electrophotographic color printer as claimed in claim 1 or 2, wherein the developer refilling/waste recovering mechanism further comprises a fastener for fixing the refill cartridge installed at the installation portion to the main body of the printer.

4. The ink delivery system of a liquid electrophotographic color printer as claimed in claim 3, wherein the fastener comprises:

a cap installed at the refill cartridge to surround a discharge hole of the refill cartridge, and provided with an engagement portion;

lockers installed at a main frame of the main body of the printer to be movable so as to be engaged with the engagement portion;

locker moving portions for moving respective lockers with respect to the main frame.

5. The ink delivery system of a liquid electrophotographic color printer as claimed in claim 2, wherein the main body of the printer comprises a main frame provided with the installation portion, and an auxiliary frame installed to be vertically movable with respect to the main frame; and the value unit comprises:

a slider at which the plurality of valves which can be selectively aligned with a discharge hole of the refill cartridge are installed at predetermined positions, and which is installed to be horizontally movable with respect to the auxiliary frame; and a slider moving mechanism, horizontally moving the slider with respect to the auxiliary frame.

6. The ink delivery system of a liquid electrophotographic color printer as claimed in claim 5, wherein the slider moving mechanism comprises:

a pair of guide rods installed at the auxiliary frame;

slider supporters installed at the slider so as to be assembled to the pair of guide rods;

a slider pinion installed at the auxiliary frame to mesh with a slider rack portion provided in a lengthwise direction of the slider to be rotated; and a slider driving motor installed at a slider bracket installed at the auxiliary frame for driving the slider pinion.

7. The ink delivery system of a liquid electrophotographic color printer as claimed in claim 2, wherein the plurality of valves includes at least three valves, which are composed a concentrated ink valve for refill a concentrated ink stored in the refill cartridge into the printer, a carrier valve for refill a carrier stored in the refill cartridge into the printer, and a waste developer valve connected to a waste developer passage in the waste tank.

8. The ink delivery system of a liquid electrophotographic color printer as claimed in claim 1, wherein a sensing unit for sensing whether the refill cartridge stores a concentration ink or carrier, and, when the refill cartridge stores a concentrated ink, sensing the color of the concentrated ink.

9. The ink delivery system of a liquid electrophotographic color printer as claimed in claim 1, wherein each concentration measuring device comprises:

a housing which includes a respective developer supplying portion and a concentration measuring portion which are provided so that the respective developer enters into or exits from the portions, and is filled with the developer to a predetermined level;

a rotating roller which is installed at the concentration measuring portion of the housing so that a portion of the rotating roller can be immersed in the developer, and on the surface of which a developer film is formed when the rotating roller rotates;

a driving source for driving the rotating roller; and a sensor for emitting a light beam to the developer film, receiving the reflected light beam after passing through the developer film, and measuring the concentration of the developer.

10. The ink delivery system of a liquid electrophotographic color printer as claimed in claim 1, wherein the waste tank comprises:

a main body provided with a cylindrical agitation portion formed to be projected from a bottom thereof;

a waste developer discharge port formed at a center of the cylindrical agitation portion; and a jet orifice formed at a side wall of the cylindrical agitation portion so as to jet a mixed waste discharged through the waste developer discharge port toward the cylindrical agitation portion.

11. The ink delivery system of a liquid electrophotographic color printer as claimed in claim 10, wherein the waste tank further comprises:

a pump installed on passage between the waste developer discharge port and the jet orifice so that the waste developer discharged from the waste developer discharge port can be jetted into the cylindrical agitation portion through the jet orifice; and a two-way valve installed on the passage between the pump and the jet orifice so as to selectively cause the waste developer discharge port to communicate with the jet orifice.

12. The ink delivery system of a liquid electrophotographic color printer as claimed in claim 1, wherein the ink storage tank comprises:

a belt-pulley installed outside the corresponding ink storage tanks so as to drive all the ink agitators; and driver which drives the belt-pulley means.

13. The ink delivery system of a liquid electrophotographic color printer as claimed in claim 1, wherein each ink agitator installed in a respective storage tank of said plurality of the ink storage tanks comprises:

a rotating shaft installed in the ink storage tank in a lengthwise direction of the ink storage tank;

a plurality of propellers radially installed at a lower end of the rotating shaft;

a cylindrical rib coaxially installed on the rotating shaft so as to connect between the propellers and to form a predetermined suction portion between the cylindrical rib and the rotating shaft; and a base plate installed around a circumferential surface of the rib so as to form a discharge portion between an inner wall of the ink storage tank and a circumferential edge of the base plate by having a shorter radial length than a length of one of the propellers and allowing a space below the base plate to communicate with the suction portion.

14. The ink delivery system of a liquid electrophotographic color printer as claimed in claim 1, wherein the system further comprises:

a water sensing sensor installed at a bottom of the carrier storage tank for sensing water in the carrier storage tank;

a water discharge pipe installed in a vicinity of the water sensing sensor; and a valve installed on the discharge pipe so as to be selectively opened or closed according to information sensed by the water sensing sensor and allow the water to be discharged to the water discharge pipe.

15. An ink refilling method of a liquid electrophotographic color printer comprising a plurality of circulation tanks which are for storing respective developers to be supplied to a developing unit, and comprise respective concentration measuring devices for measuring a concentration of the developers; a waste tank receiving waste developer produced in the plurality of circulation tanks and provided with a waste developer agitating device for agitating the waste developer; a plurality of ink storage tanks which store concentrated inks of predetermined colors to be supplied to the circulation tanks, respectively, and in which respective ink agitators driven by a single driving source are installed; a carrier storage tank which stores a carrier to be supplied to the circulation tanks, and is provided with an inclined surface at the bottom so that water and a liquid carrier condensed by a drying/condensing unit can be stored in a stratified state; a refill cartridge which stores a concentrated ink or carrier with compressed air and is removably installed at a common installation portion provided at a main body of the printer; and a developer refilling/waste recovering mechanism which refills a concentrated ink or carrier of the refill cartridge into a corresponding ink storage tank or carrier storage tank and recovers the waste developer stored in the waste tank to an empty refill cartridge including the steps of:

(a) determining whether necessity of refilling any one of the concentrated inks and the carrier exists;

(b) inserting the refill cartridge corresponding to the ink or carrier storage tank requiring a refill into the common installation portion;

(c) confirming an identity of the refill cartridge inserted in the installation portion;

(d) aligning a corresponding valve of a valve unit with a discharge hole of the identified refill cartridge;

(e) fixing the refill cartridge to the installation portion with a fastener;

(f) raising the valve unit by a valve raising/lowering mechanism so as to connect the aligned valve to the discharge hole;

(g) rapidly injecting the ink or carrier into the corresponding ink storage tank or carrier storage tank;

(h) lowering the valve unit by the valve raising/lowering mechanism; and (i) removing the refill cartridge from the installation portion.

16. The ink refilling method of a liquid electrophotographic color printer as claimed in claim 15, wherein the step (d) includes the steps of:

initializing the valve unit;

moving the valve unit by a predetermined distance; and precisely positioning the valve unit by sensing centers of valve position mark portions with a valve unit position sensor.

17. The ink refilling method of a liquid electrophotographic color printer as claimed in claim 16, wherein the step (f) or (h) includes the steps of:

rotating cam driving motor of the valve raising/lowering mechanism counterclockwise a predetermined number of degrees so as to raise or lower the valve unit; and operating the valve unit position sensor to sense a vertical position of the valve unit.

18. The ink refilling method of a liquid electrophotographic color printer as claimed in claim 15, wherein the step (e) or (i) includes the steps of:

rotating a cam driving motor of the valve raising/lowering mechanism clockwise a predetermined number of degrees; and sensing positions of lockers being engaged with an engagement portion provided at the refill cartridge.

19. The ink refilling method of a liquid electrophotographic color printer as claimed in claim 15, wherein the step (e) includes the step of rotating the refill cartridge so that a cap installed at the refill cartridge can be screwed to an engagement portion formed at the installation portion.

20. The ink refilling method of a liquid electrophotographic color printer as claimed in claim 15, wherein the step (i) includes the step of rotating the refill cartridge so that a cap of the refill cartridge engaged with a engagement portion of the installation portion can be unscrewed.

21. The ink refilling method of a liquid electrophotographic color printer as claimed in claim 15, wherein, after the step (h), the method further includes the step of recovering waste liquid developer in the waste tank to an empty refill cartridge.

22. The ink refilling method of a liquid electrophotographic color printer as claimed in claim 21, wherein the step (i) comprises the steps of:

moving the valve unit by a predetermined distance so as to align a waste developer valve installed at the valve unit with the discharge hole of the empty refill cartridge;

raising the valve unit by the valve raising/lowering mechanism;

supplying the waste developer in the waste tank to an empty refill cartridge by operating a pump; and lowering the valve unit by the valve raising/lowering mechanism so as to disconnect the waste developer valve from the discharge hole.

23. The ink refilling method of a liquid electrophotographic color printer as claimed in claim 15, wherein the step (e) or (i) includes the steps of:

securing the refill cartridge with the fastener so that the refill cartridge is fastened to the installation portion; and sensing a position of the fastener.

24. The ink refilling method of a liquid electrophotographic color printer as claimed in claim 23, wherein said step of securing the refill cartridge includes rotating a cam driving motor a predetermined number of degrees, engaging the fastener so that the refill cartridge is fastened to the installation portion.

25. The ink refilling method of a liquid electrophotographic color printer as claimed in claim 23, wherein said step of sensing a position of the fastener comprises sensing a position of lockers being engaged with an engagement portion of a cap of the refill cartridge.

26. The ink refilling method of a liquid electrophotographic color printer as claimed in claim 25, wherein said step of sensing a position of the fastener includes confirming that the refill cartridge is secured to the installation portion.

27. The ink refilling method of a liquid electrophotographic color printer as claimed in claim 25, wherein said step of sensing a position of the fastener includes maximizing a fixing force securing the refill cartridge to the installation portion.

28. The ink refilling method of a liquid electrophotographic color printer as claimed in claim 15, wherein the step (i) includes the step of disengaging the fastener securing the refill cartridge to the installation portion.

* * * * *